US007725071B2

(12) United States Patent
Izuchi et al.

(10) Patent No.: US 7,725,071 B2
(45) Date of Patent: May 25, 2010

(54) BOTH SIDE PRINTABLE PRINTER

(75) Inventors: Masatoshi Izuchi, Nagoya (JP); Masaru Takeuchi, Handa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 596 days.

(21) Appl. No.: 11/565,331

(22) Filed: Nov. 30, 2006

(65) Prior Publication Data

US 2007/0122225 A1 May 31, 2007

(30) Foreign Application Priority Data

Nov. 30, 2005 (JP) ..... 2005-345766

(51) Int. Cl.
*G03G 15/00* (2006.01)

(52) U.S. Cl. ..... 399/401; 399/397

(58) Field of Classification Search ..... 399/405, 399/407, 401, 397

See application file for complete search history.

(56) References Cited

U.S. PATENT DOCUMENTS

| | | | | |
|---|---|---|---|---|
| 5,781,823 | A * | 7/1998 | Isobe et al. | 399/2 |
| 5,953,575 | A * | 9/1999 | Park et al. | 399/401 |
| 5,974,283 | A * | 10/1999 | Cho | 399/75 |
| 6,606,464 | B2 * | 8/2003 | Asakawa | 399/51 |
| 6,877,854 | B2 * | 4/2005 | Nishikawa | 347/104 |
| 6,892,048 | B2 | 5/2005 | Eskey | |
| 6,909,872 | B2 | 6/2005 | Eskey | |
| 6,964,466 | B1 * | 11/2005 | Kodama et al. | 347/36 |
| 6,975,814 | B2 | 12/2005 | Tsusaka et al. | |
| 2002/0192000 | A1 * | 12/2002 | Yasui et al. | 400/582 |
| 2006/0268089 | A1 | 11/2006 | Takeuchi | |

FOREIGN PATENT DOCUMENTS

| | | |
|---|---|---|
| JP | 2002135525 | 5/2002 |
| JP | 2004102165 | 4/2004 |
| JP | 2004170942 | 6/2004 |
| JP | 200589152 | 4/2005 |
| JP | 200589153 | 4/2005 |
| JP | 2005156140 | 6/2005 |
| JP | 2006327793 A | 12/2006 |

* cited by examiner

*Primary Examiner*—Anthony H. Nguyen
(74) *Attorney, Agent, or Firm*—Baker Botts, LLP.

(57) ABSTRACT

A printer including a printing unit for printing on a sheet, a cassette containing stacked sheets and located below the printing unit, a supply unit that feeds the sheet from the cassette toward the printing unit, a sheet support plate positioned in the printing unit where the sheet is placed during printing, and an opening formed on the sheet support plate. A cover plate is located in the printing unit and moves between a covering position to cover the opening and an uncovering position to uncover the opening. The cover plate is at the covering position during printing, and the cover plate is at the uncovering position when a pair of feed-out rollers rotates in a reverse direction to guide the sheet through the opening of the sheet support plate to a refeed position between the cassette and the supply unit.

9 Claims, 21 Drawing Sheets

BOTH SIDE PRINTABLE PRINTER

CROSS REFERENCE TO RELATED APPLICATION

This application claims priority to Japanese Patent Application No. 2005-345766 filed on Nov. 30, 2005, the contents of which are hereby incorporated by reference into the present application.

BACKGROUND OF THE INVENTION

1. Field of the Invention

The present invention relates to a printer capable of printing on both sides of a piece of sheet (hereinafter, "a piece of sheer" may simply referred to as a sheet). The printer of the present invention is generic name of a device that transport cut sheets one after the other from a sheet case to a printing unit where characters, graphics, or photographs, etc., are sequentially printed on each sheet. It is not limited to a single-function printer and instead, a copier, a facsimile machine, a complex device (or a multifunction device) or the like that comprises a device for printing on a sheet corresponds to what we call a "printer" herein.

2. Description of the Related Art

Recently, in order to save resources, printers capable of printing on both sides of each sheet have been actively introduced into offices or homeplaces.

In general, a printer that prints on one side of a sheet has a cassette (or a sheet case), a printing unit, and a supply unit. Sheets not yet printed are accommodated in the cassette. The printing unit comprising a printing head which discharges ink droplets or toner on the sheet. The supply unit feeds a piece of sheet one by one from the cassette to the printing unit. Printing on both sides of sheets further requires a sheet returning mechanism for transporting sheet one side of which has been printed at the printing unit, to the printing unit once again. Japanese Patent Application Laid-Open No. 2004-102165 (see particularly FIG. 2) discloses one example of a printer having a sheet returning mechanism that enables both side printing (double face printing). This printer is configured as described below. On the lower side of a case of a printer, the cassette in which stacked sheets are contained is located. On the tipper side of the case, the printing unit comprising a toner type printing head that discharges ink droplets by means of an electro photograph process is located. Between the printing unit located above and the cassette located below, the supply unit is located. The supply unit feeds a sheet from the cassette to the printing unit. The supply unit feeds sheets one by one from the cassette toward the printing unit. A sheet fed from the cassette runs through a U-shaped feed-in pathway. The U-shaped feed-in pathway guides the sheet to the printing unit. The sheet guided to the printing unit is printed on one side by the printing unit. The one side printed sheet is discharged (or pulled out) from the printing unit through a feed-out pathway. The one side printed sheet once stops on the feed-out pathway. Then, the sheet is back-fed through the feed-out pathway and transported to return pathway that diverges from the feed-out pathway. The feed-out pathway diverged from the feed-out pathway extends downward along with the lateral side of the printing unit. The return pathway bends from the side on the printing unit toward above the cassette. The return pathway passes between the cassette and the printing unit, and joins into feed-in pathway. Along the return pathway, a number of rollers are arranged for transporting sheets. Passing through the return pathway and feed-in pathway, the one side printed sheet is fed again to the printing unit. The return pathway and the number of rollers arranged along with the return pathway forms sheet returning mechanisms that enable both side printing. Passing through the U-shaped feed-in pathway, sheets are reversed upside down and transported to the printing unit. In other words, the surface that is the top face of the sheet when the sheet is in the cassette becomes the underside when the sheet is in the printing unit. Passing through the U-shaped feed-in pathway once again, the one side printed sheet will have other side printed.

BRIEF SUMMARY OF THE INVENTION

In the printer disclosed in Japanese Patent Application Laid-Open No. 2004-102165, the return pathway runs along the lateral side of the printing unit and between the printing unit and the cassette. The printer has such a structure that the printing unit, the return pathway, and the cassette overlap along with the vertical direction, which makes the printer grow in size. In addition, the printer has to carry the one side printed sheet along the long return pathway, a number of rollers should be arranged along the return pathway. This increases the number of components that enable both side printing.

The present invention is made to solve the conventional problems described above. It is an object of the present invention to provide a small-size both side printable printer that has a fewer number of components and a simple structure.

The printer of the present invention comprises a printing unit for printing onto a sheet, a cassette located below the printing unit and for containing stacked sheets, and a supply unit for discharging (feeding) one sheet from the cassette toward the printing unit. The printer also comprises a sheet support plate located in the printing unit. The sheet fed from the cassette by the supply unit is placed on the sheet support plate during being printed. An opening is formed on the sheet support plate. The printer also comprises a cover plate being movable between a covering position that covers the opening and an uncovering position that uncovers the opening. The printer also comprises a pair of feed-out rollers that nips a sheet at the exit of the printing unit. The pair of feed-out rollers pulls out the nipped sheet from the printing unit by rotating in a forward direction. The cover plate is moved at the covering position during printing. The cover plate moved at an uncovering position when the pair of feed-out rollers rotates in a reverse direction to return the sheet (nipped and pulled out by the pair of feed-out rollers) to the cassette through the opening of the sheet support plate.

What is herein meant by the rotation in a forward direction of the pair of feed-out rollers is the rotation direction of the pair of feed-out rollers when the nipped sheet is pulled out from the printing unit. If the pair of feed-out rollers continues to rotate in the forward direction after nipping the sheet, it can discharge the one side printed sheet out of the printer.

The pair of feed-out rollers feeds the one side printed sheet back to the printing unit. The back fed sheet passes through the opening formed on the sheet support plate and returns to the cassette located below the printing unit. A pathway of sheet from the opening formed on the sheet support plate to the cassette corresponds to a return pathway. The sheet support plate is arranged above the cassette. Therefore, the return pathway guides the one side printed sheet almost linearly from the opening formed on the sheet support plate to the cassette, which can shorten the return pathway. Thus, not only the number of rollers for carrying the one side printed sheet along the return pathway can be reduced but also size of the printer can be miniaturized. In addition, the one side printed sheet returned to the cassette can be fed again to the printing unit by the supply unit that feeds unprinted sheets from the cassette to the printing unit. In other words, the supply unit can be used for feeding both of unprinted sheets and one side printed sheets to the printing unit. It can reduce the number of components that enable both side printing.

The printer according to the present invention preferably has the following technical characteristics (A).

(A) The supply unit has a supply roller that is driven by motor to rotate. When the supply unit feeds a sheet, the supply roller is pressed against the top of the stacked sheets. A piece of sheet on the top of the stacked sheets is fed from the cassette by rotating supply roller. When the piece of sheet (the sheet is printed on its one side) returns to the top of the stacked sheets through the return pathway, the supply roller detaches from the top of the stacked sheets. The supply roller is pressed again against the top of the stacked sheets after the one side printed sheet returns to the top of the stacked sheet. The one side printed sheet is smoothly carried on the stacked sheets as the supply roller detaches from the top of the stacked sheets.

Instead of the technical characteristics (A), the printer may have the following technical characteristics (B).

(B) The supply unit has a supply roller that is pressed against the top of the stacked sheets. When the supply unit feeds a sheet, the supply roller is driven by motor to rotate. A piece of sheet on the top of the stacked sheets is fed from the cassette by rotating supply roller. When the piece of sheet (the sheet is printed on its one side) returns to the top of the stacked sheets through the return pathway, the supply roller becomes freely rotatable from the drive motor. The supply roller is driven again to rotate after the one side printed sheet returns to the top of the stacked sheet. The one side printed sheet is smoothly inserted between the supply roller and top of the stacked sheet as the supply roller becomes freely rotatable when the one side printed sheet returns to the cassette.

The printer according to the present invention preferably has the following technical characteristics in addition to the above technical characteristics (A). The pair of feed-out rollers releases the force of nipping when the supply roller is pressed again against the top of the stacked sheets. In addition to the above technical characteristics (B), it preferably has the following technical characteristics. The pair of the feed-out roller releases the force of nipping when the supply roller is driven again.

According to any of the above technical characteristics, the one side printed sheet returned to the cassette is smoothly fed again by the supply roller because the pair of feed-out rollers releases the one side printed sheet.

In addition, the printer of the present invention preferably has the following technical characteristics. When the cover plate is at the covering position, the top face thereof forms a plane (planar surface) together with the top face of the sheet support plate. In addition, when the cover plate is at the uncovering position, the top face thereof tilts to the top face of the sheet support plate. By forming the planar surface together with the top face of the sheet support plate, the cover plate does not prevent movement of a sheet being printed. On the one hand, as the cover plate tilts, one side printed sheet can smoothly enter the opening formed on the sheet support plate and transported to the cassette located below the sheet support plate.

It is preferable that the printer of the present invention further has a pair of feed-in rollers. The pair of the feed-in rollers nips a sheet in front of the inlet of the printing unit and carries the nipped sheet into the printing unit by rotating in the forward direction. The pair of feed-in rollers and the pair of feed-out rollers rotate simultaneously in the same direction. In other words, the pair of feed-in rollers rotates in the forward direction while the pair of feed-out rollers rotates in the forward direction, and the former rotates in the reverse direction when the latter rotates in the reverse direction. Such the configuration could eliminate the need for controlling the pair of feed-in rollers and the pair of the feed-out rollers independently during double-side printing and during intermittent feeding. The intermittent feeding will be described later. Control for conducting the double-side printing of the printer can be simplified.

The printing unit of the printer according to this invention preferably has a printing head of ink discharging method that selectively discharges ink droplets onto sheets. The sheet support plate, while having the function of defining a gap between a sheet lying thereon and the printing head, is also used as a member for guiding one side printed sheet to the cassette through the opening. This could enable reduction of the number of components and miniaturization of the printer.

DETAILED DESCRIPTION OF THE INVENTION

Figure 1:
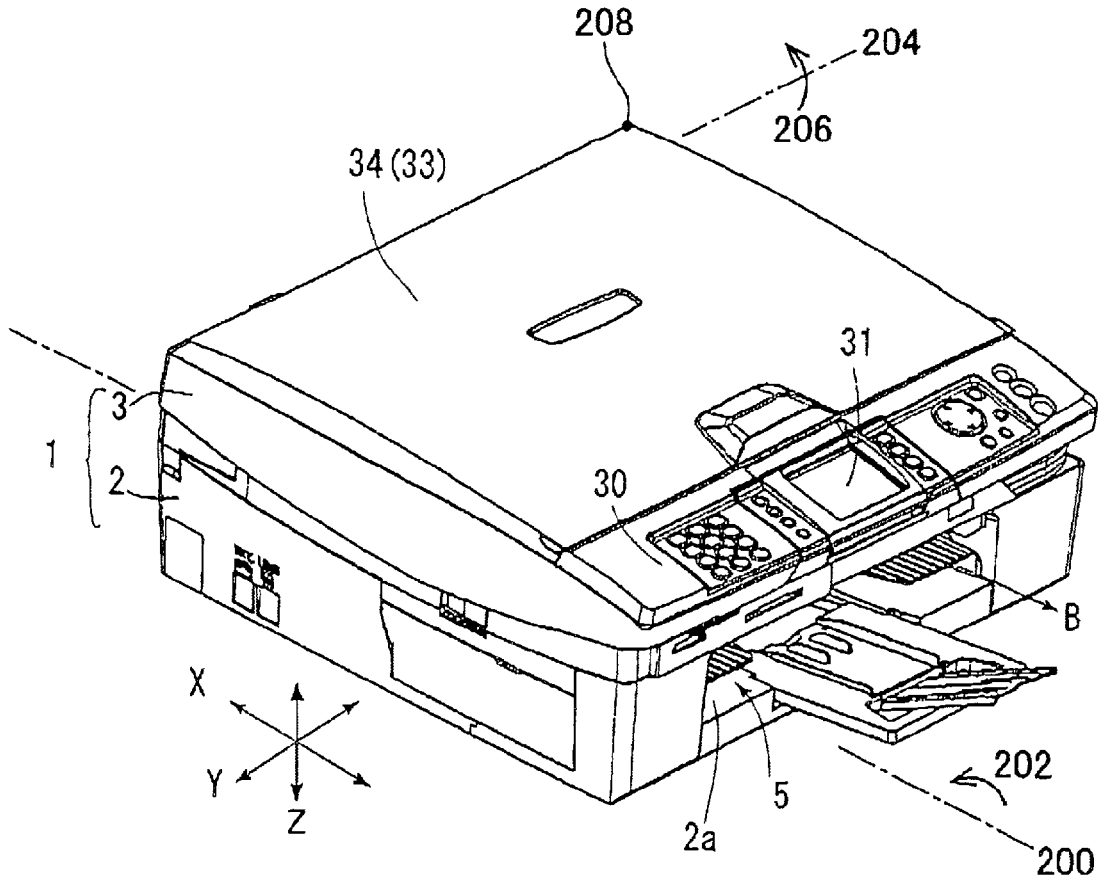
FIG. 1 is an overall perspective view of a multi-function device.

Embodiments of the present invention will be described in detail with reference to the drawings. FIG. 1 is an external perspective view of a multi-function device 1 equipped with the facsimile function, printing function, copying function, and scanner function. The multi-function device 1 transports one by one sheets contained in a cassette by a supply unit to a printing unit, and prints characters, graphics, photographs, etc. (hereinafter generically referred to as graphic patterns) on the transported sheets.

The multi-function device 1 has a lower case 2 and an upper case 3. The lower case 2 is shaped almost like a box with a top face opened. Coupled to the left flank of the lower case 2 by way of hinges (not shown), the upper case 3 is rotatable from a position in FIG. 1 in arrow 202 direction around a rotation axis 200. When the upper case 3 rotates in an arrow 202 direction, interior of the lower case 2 becomes visible from the external.

In the following description, X direction of FIG. 1 is referred to as a cross direction, Y direction is referred to as a horizontal direction, and Z direction is referred to as a vertical direction.

An operation panel 30 is located on the front of a top face of the upper case 3. Various types of buttons such as numeric buttons, Start button, or Select Function buttons, etc. are provided on the operation panel 30. Pressing these buttons, various operations can be executed. A liquid crystal display (LCD) 31 is provided on the operation panel 30 where set conditions of the multi-function device 1 or various operation messages, etc. are displayed, as necessary.

A scanner device 33 is placed inside the upper case 3. The scanner device 33 comprises a glass plate (not shown) on which a script is placed, a graphic pattern reader unit (not shown) located beneath the glass plate, and a cover 34 covering a top face of the glass plate. The cover 34 is rotatable around a rotation axis 204 from a position in FIG. 1 in an arrow 206 direction. When the cover 34 rotates in the arrow 206 direction, the glass plate is exposed so that the script can be placed thereon. The graphic pattern reader unit comprises a contact image sensor (CIS), extends along in the X direction. A rail (not shown) is provided to guide the graphic reader unit so as to reciprocate the graphic pattern reader unit along Y axis direction. The graphic pattern reader unit reads graphic patterns in the script placed on the glass plate by means of the contact image sensor.

When the facsimile function is selected, information read by the graphic pattern reader unit is sent to a facsimile unit at a destination through a telephone circuit. When the copy function is selected, information read by the graphic pattern reader unit is sent to a printing unit in the multi-function device 1, and graphic patterns read by the graphic pattern reader unit are printed on a sheet. When the scanner function is selected, information read by the graphic pattern reader unit is sent to a computer (not shown).

There is provided a posture retention means to maintain the interior of the lower case 2 exposed, by widely rotating the upper case 3 around the rotation axis 200. The posture retention means is comprised of a support rod (not shown) and a guide rail (not shown). One end of the support rod is attached to the vicinity of point 208 of the lower case 2 and can be swung with respect to the lower case 2. The guide rail extends in the Y direction along a lower face of the backside of the upper case 3. A channel extending in the Y direction is formed on the guide rail. A guide pin is fixed to the other end of the support rod and inserted into said channel. An engagement unit (not shown) for preventing the guide pin from sliding is formed in the vicinity of point 208. When the upper case 3 is widely rotated around the rotating shaft 200, the guide pin of the support rod fits into the engagement unit of the guide rail and prevents the upper case 3 from widely rotating downward.

Next, a structure for printing graphic patterns on sheets contained in the cassette will be described with reference to FIG. 1 to FIG. 14. The structure is located in the lower case 2 of the multi-function device 1. As shown in FIG. 1, a cassette 5 is arranged at the center part of the horizontal direction in the lower case 2. The cassette 5 is such configured that it can be pulled out with respect to an opening 2*a* formed on the front face of the lower case 2. The cassette 5 contains more than one sheet P in a stacked condition. A separation inclined surface 8 are provided at the front end of the cassette 5. The separation inclined surface 8 is formed of material having a high coefficient of friction.

As shown in FIG. 5, FIG. 11 to FIG. 14, in the lower case 2, a supply unit 6, a U-shaped sheet guide 9, and a printing unit 10 are arranged in addition to the cassette 5.

Figure 11:
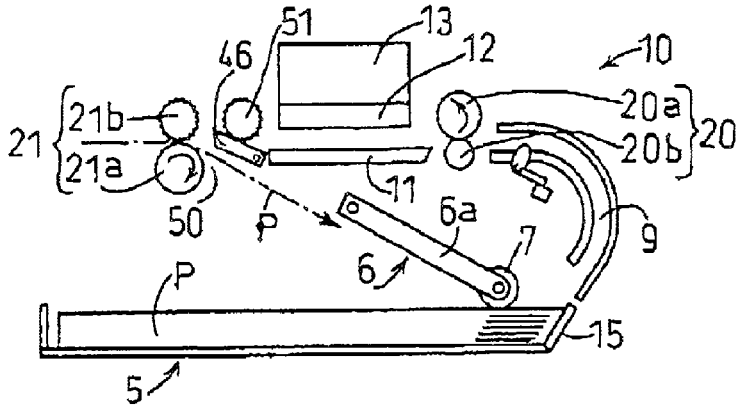
FIG. 11 to FIG. 14 are schematic sectional views illustrating the operation of carrying a sheet during double-side printing.

The supply unit 6 and the printing unit 10 are attached to a metal frame 39 fixed into the lower case 2. As shown in FIG. 11, the cassette 5 is located below the printing unit 10. A sheet P is discharged from the cassette 5 and fed into the printing unit 10 through the U-shaped sheet guide 9.

As shown in FIG. 2 to FIG. 5, a frame 39 is located on the backside of the lower case 2 and above the cassette 5. The frame 39 comprises a bottom surface 39*a* extending in the Y axis direction, a left wall 39*b* rising upward from the left end of the bottom surface 39*a*, a right wall 39*c* rising upward from the right end of the bottom surface 39*a*, a front side guide plate 41 connecting the left wall 39*b* and the right wall 39*c*, and a back side guide plate 40 connecting the left wall 39*b* and the right wall 39*c*. The front side guide plate 41 and the backside guide plate 40 extend in the Y direction.

The supply unit 6 is located above the cassette 5. The supply unit 6 feeds a piece of sheet P on top of the stacked sheets in the cassette 5 toward the printing unit 10. The sheet P fed from the cassette 5 by the supply unit 6 is guided along the U-shaped sheet guide 9 into the printing unit 10. As shown in FIG. 11, the U-shaped sheet guide 9 flips the sheet that entered from the end thereof and guides it to the printing unit 10.

Figure 9:
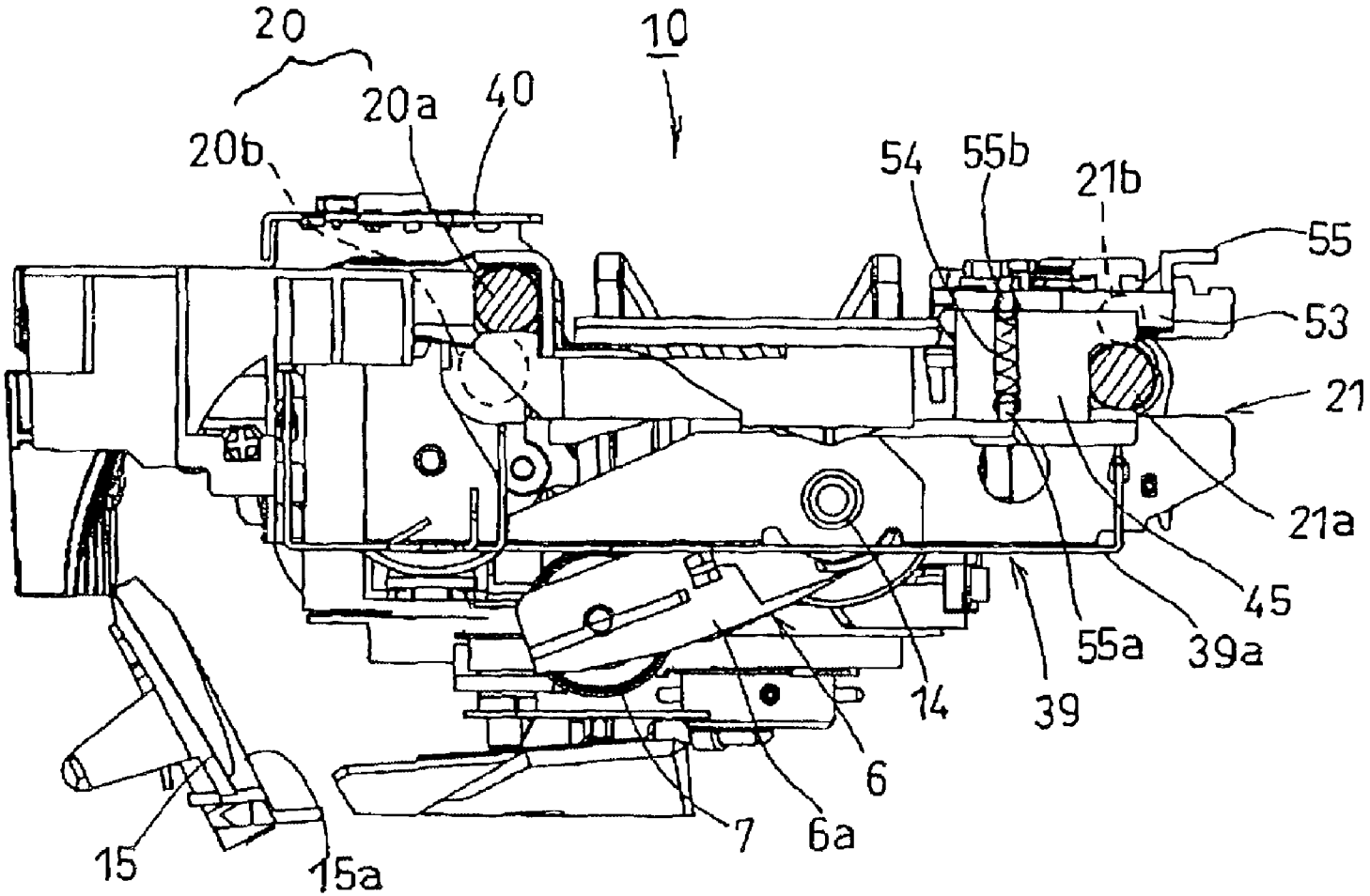
FIG. 9 is an enlarged sectional view of the printing unit and the supply unit.
Figure 10:
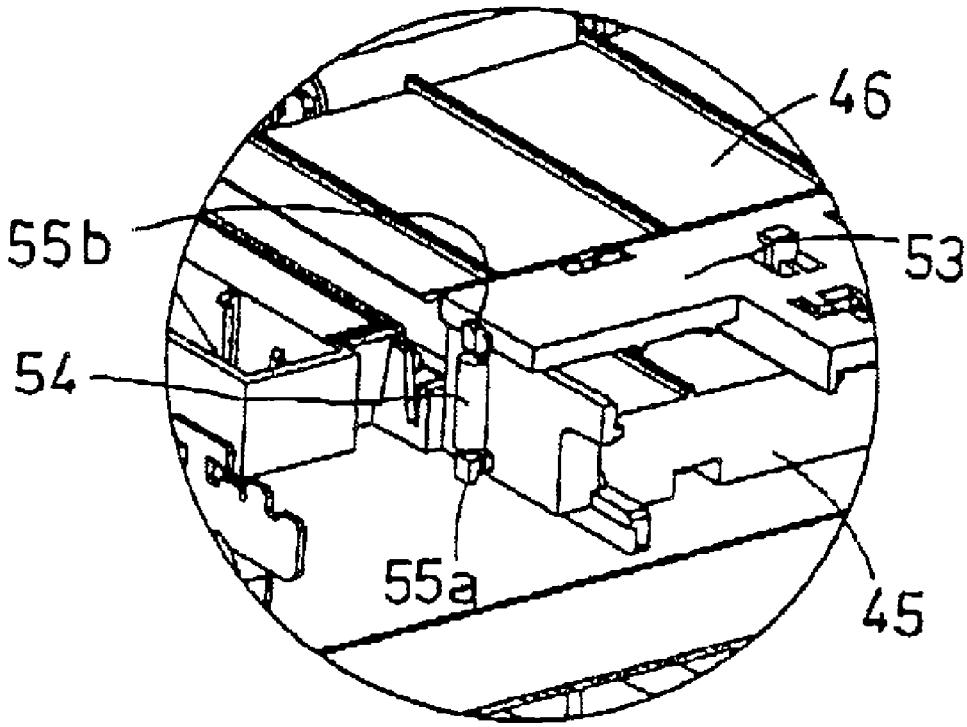
FIG. 10 is an enlarged perspective view of the vicinity of a roller holder.

As shown in FIG. 9, the supply unit 6 comprises an arm 6*a* and a supply roller 7. One end of the arm 6*a* is rotatably coupled to the bottom surface 39*a* of the frame 39 by a drive shaft 14. The supply roller 7 is attached to other end of the arm 6*a*. The arm 6*a* is always biased downward by a biasing means (not shown) such as a torsion spring, etc. In other words, the supply roller 7 attached to the other end of the arm 6*a* is pressed against the top of the stacked sheets in the cassette 5.

Figure 4:
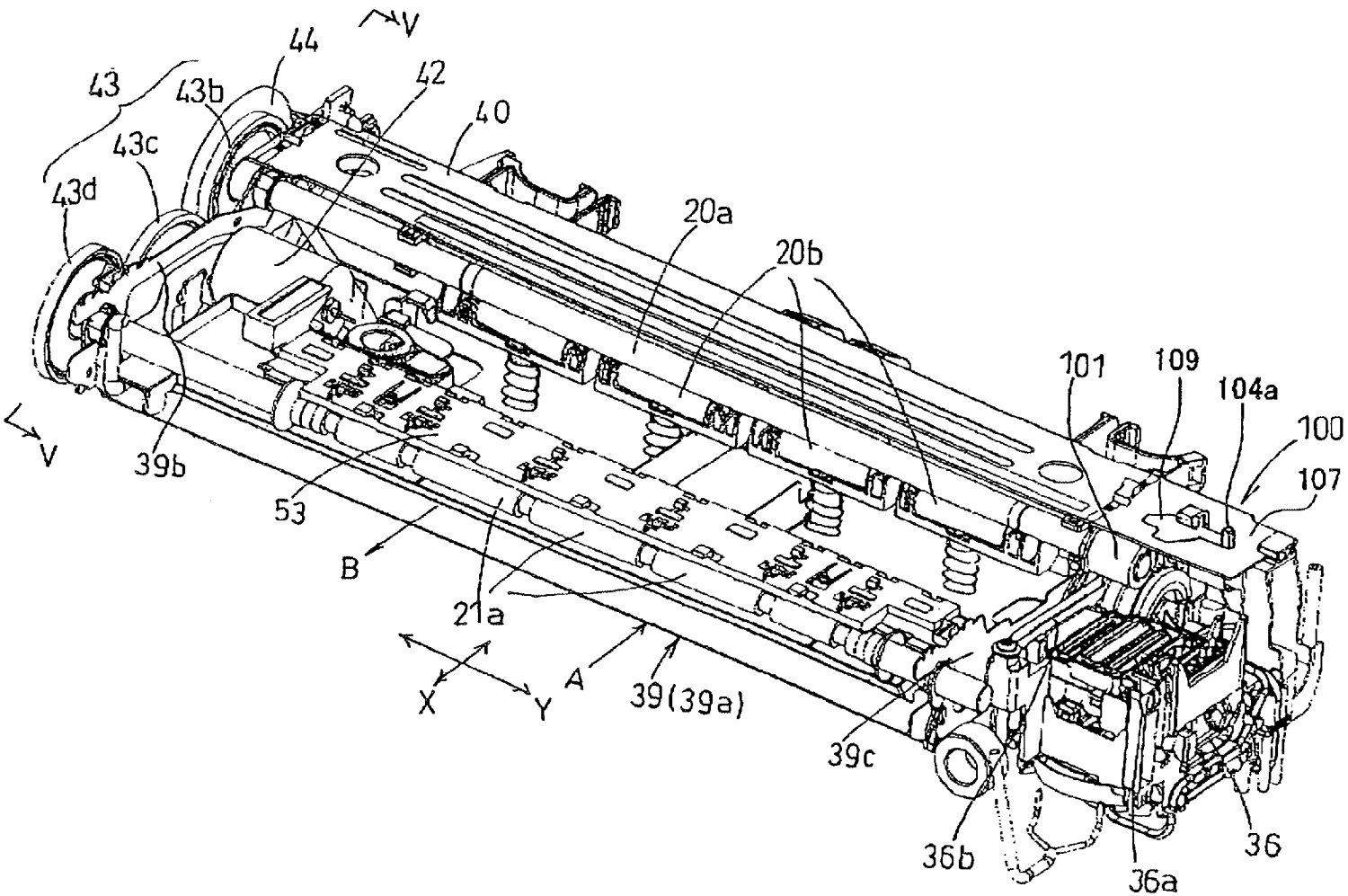
FIG. 4 is a perspective view of the printing unit with the guide plate on the rear side and the sheet support plate removed.
Figure 5:
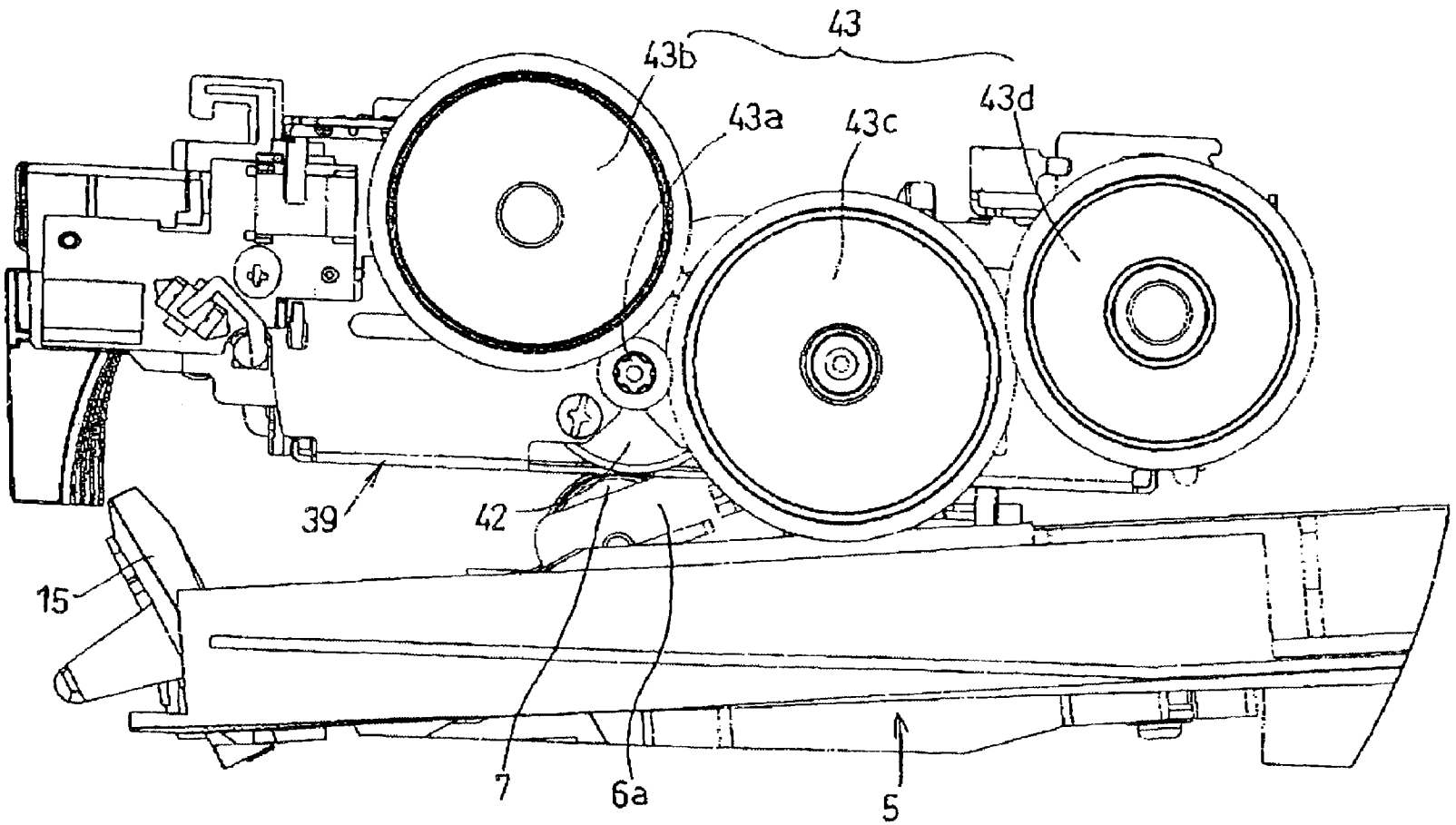
FIG. 5 is a view taken along V-V line of FIG. 4.

A plurality of gear groups (not shown) for transmitting power from the drive shaft 14 to the supply roller 7 is provided on the arm 6*a*. Power of an LF motor 42 is transmitted to the drive shaft 14 and the supply roller 7 by the gear groups. When the LF motor 42 rotates in the reverse direction, the supply roller 7 rotates in the direction so as to discharge a top sheet P of the stacked sheets toward the printing unit 10. The gear groups are such configured that the supply roller 7 can freely rotate around the drive shaft 14 when the LF motor 42 rotates in the forward direction. In other words, the supply roller 7 is disengaged from the LF motor 42. To be specific, the gear groups have such structure that engagement among some gears is released when the LF motor 42 rotates in the forward direction. As shown in FIG. 4, the LF motor 42 is located at the left end of the frame 39.

With reference to FIG. 11, the mechanism for discharging sheets one by one from the stacked sheets in the cassette 5 toward the printing unit 10 will be described.

First, let the LF motor 42 rotate in the reverse direction. When the LF motor 42 rotates in the reverse direction, the drive shaft 14 supporting the arm 6*a* of the supply unit 6 rotates clockwise. When the drive shaft 14 rotates clockwise, the supply roller 7 rotates anticlockwise. The supply roller 7 contacts the top of the stacked sheets in the cassette 5. Thus, as the supply roller 7 rotates anticlockwise, a top sheet P of the stacked sheets is discharged to the U-shaped sheet guide 9 (discharged toward the printing unit 10).

At the end of the U-shaped sheet guide 9 on the side of the printing unit 10 is arranged a pair of feed-in rollers 20*a*, 20*b*, to be discussed later. When the LF motor 42 rotates in the reverse direction, the feed-in roller 20*a* rotates anticlockwise (and the feed-in roller 20*b* rotates clockwise). Thus, the sheet P that reaches the pair of feed-in rollers 20*a*, 20*b* comes to rest, abutting against the pair of feed-in rollers 20*a*, 20*b*, without getting caught up between the feed-in rollers 20*a*, 20*b*.

Then, let the LF motor 42 rotate in the forward direction. When it does so, the feed-in roller 20*a* rotates clockwise (and the feed-in roller 20*b* rotates anticlockwise). The sheet P is get caught between the pair of feed-in rollers 20*a*, 20*b*. In other words, sheet P is nipped by the pair of the feed-in rollers 20*a*, 20*b*. Furthermore, when the feed-in roller 20*a* rotates clockwise, the sheet P is fed to the left. In fact, the sheet P is carried into the printing unit 10. On the one hand, when the LF motor 42 rotates in the forward direction, the drive shaft 14 rotates anticlockwise. When the drive shaft 14 rotates anticlockwise, the supply roller 7 becomes freely rotatable around the drive shaft 14, as described earlier. In other words, the supply roller 7 is disengaged from the LF motor 42. Since the supply roller 7 is disengaged from the LF motor 42, no sheet is discharged from the stacked sheets. This could make it possible to transport sheets one by one from the cassette 5 to the printing unit 10.

The printing unit 10 comprises a printing head 12 of ink jet method that selectively jets ink droplets towards a surface of a sheet, a carriage 13 supporting the printing head 12, and a sheet support plate 11 which supports sheets below the printing head 12. The sheet support plate 11 is made of synthetic resin. Guided into the printing unit 10 by the U-shaped sheet guide 9, the sheet P is carried onto the sheet support plate 11. When the sheet P is carried onto the sheet support plate 11, the printing head 12 prints given graphic patterns onto the sheet P. As described later, the printed sheet P is pulled out from the printing unit 10 by a pair of feed-out rollers 21*a*, 21*b*. Structure of the sheet support plate 11 will be described later. In the following, in the printing unit 10, the side into which the sheet P is carried from the cassette 5 may be referred to as an inlet of the printing unit. The side from which a printed sheet P is discharged after printing may be referred to as the exit of the printing unit 10. An area that lies between the inlet and exit as well as between the printing head 12 and the sheet support plate 11 may be referred to as a printing area.

The carriage 13 supporting the printing head 12 is slidably supported by the front side guide plate 41 and the backside guide plate 40 of the frame 39.

Figure 2:
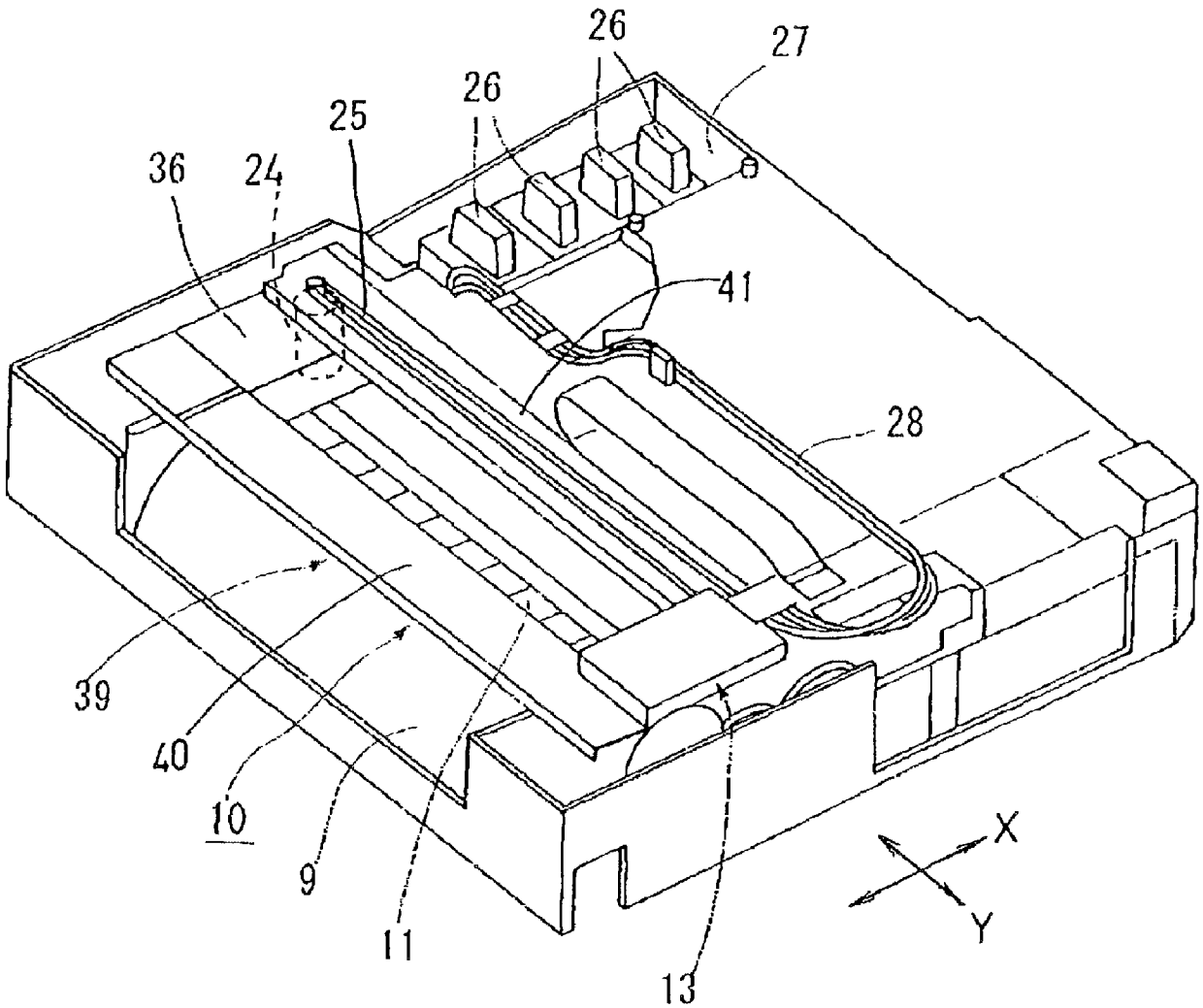
FIG. 2 is a perspective view of the lower case viewed from the back, with the upper case removed.
Figure 6:
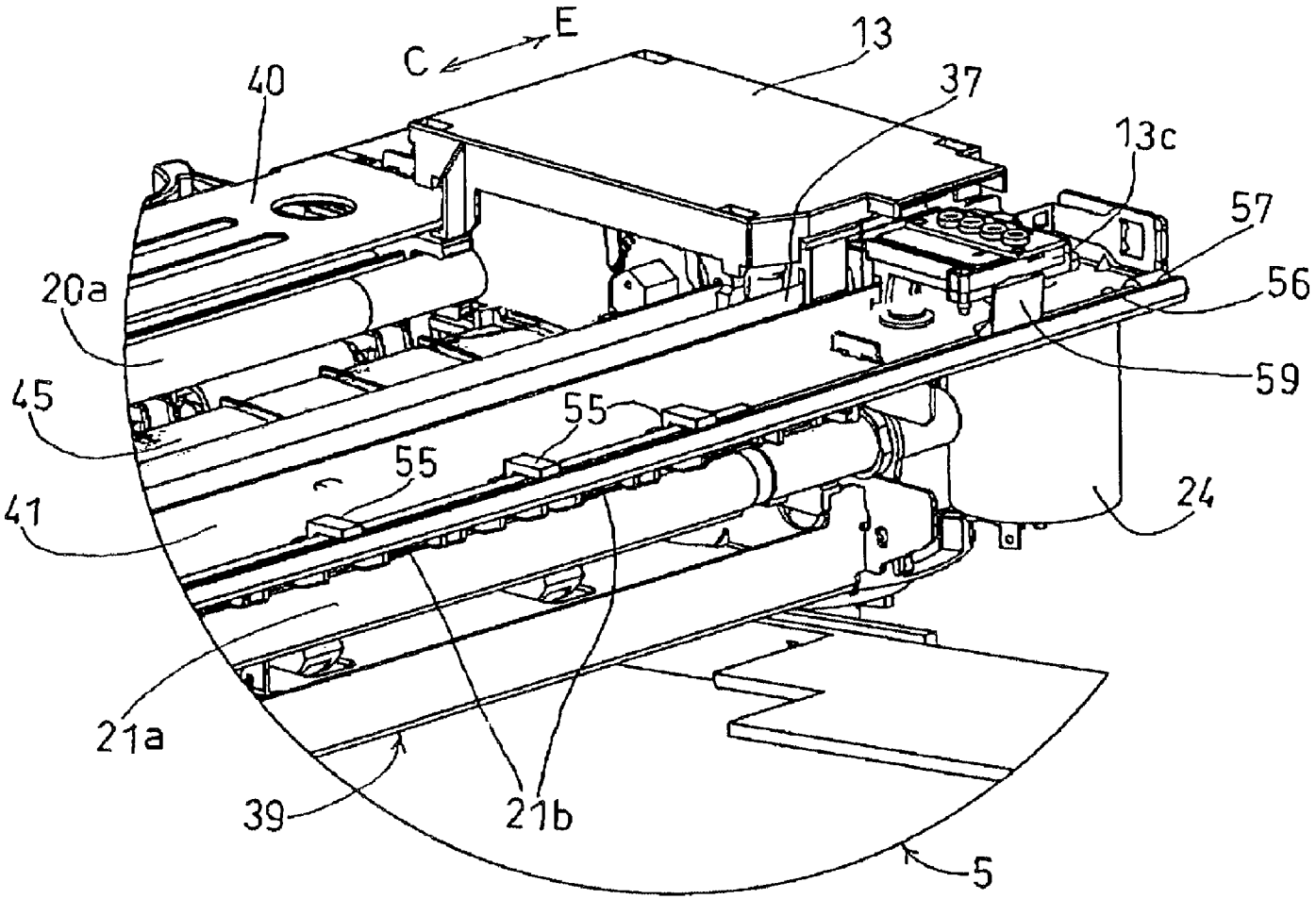
FIG. 6 is a perspective view viewed from the side of the pair of feed-out rollers of the condition in which a carriage is located on a maintenance unit.

To have the carriage 13 reciprocate, on a top face of the front side guide plate 41 located downstream of a transport direction of the sheet P (an arrow A direction of FIG. 4) is arranged a timing belt 25 extending in a main scanning direction (the Y axis direction) (See FIG. 2). Respective ends of the timing belt 25 are supported by pulleys 25*a*, 25*b*. The timing belt 25 is driven by a CR (carriage) motor 24. The CR motor 24 (a DC motor in this embodiment) is fixed to the underside of the front side guide plate 41 (See FIG. 2 and FIG. 6). As shown in FIG. 6, a strip-shaped linear encoder (encoder strip) 37 is arranged on the front side guide plate 41 on the downstream side. The linear encoder 37 extends along the main scanning direction (Y axis direction). The linear encoder 37 detects a position or speed of the carriage 13 in the main scanning direction (Y axis direction). The linear encoder 37 has an inspection surface (a surface on which slits are arranged with same intervals in the Y axis direction). The linear encoder 37 is arranged on the front side guide plate 41 so that the inspection surface is opposed to the flank of the carriage 13.

The multi-function device 1 is capable of color printing. Ink cartridges 26 for supplying ink to the printing head 12 for color printing are detachably arranged in the lower case 2. The respective ink cartridges 26 contain ink of each color. In the case of the multi-function device 1, ink of 4 colors, namely, black (B), cyan (C), magenta (M), and yellow (Y) is respectively contained in the four ink cartridges 26. Needless to say, in a printer using more than 3 colors of ink may be such structured that as many ink cartridges as the number of ink colors can be accommodated. Ink is supplied from the respective ink cartridges 26 to the printing head 12 by way of flexible ink tubes 28 (See FIG. 2).

Figure 3:
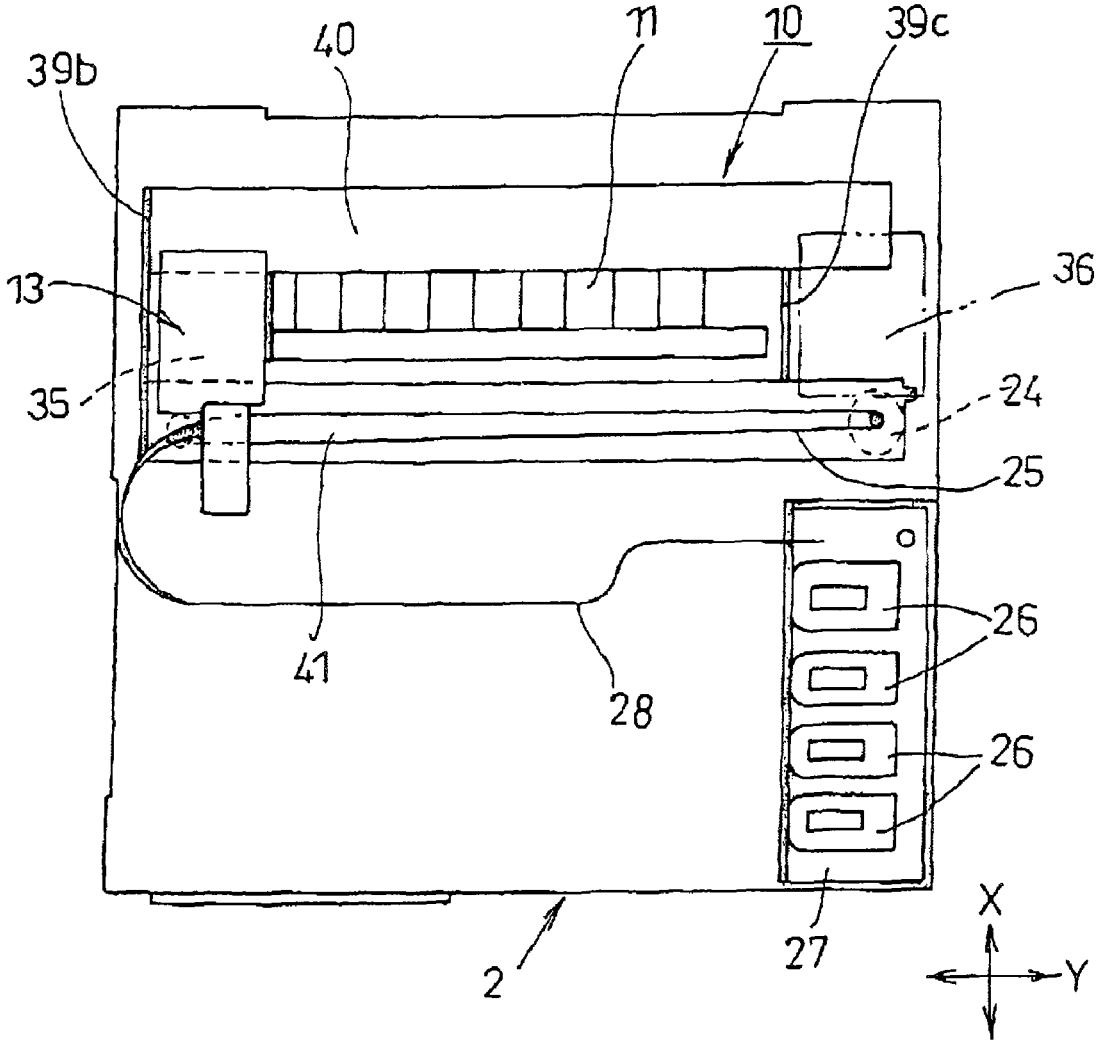
FIG. 3 is a plan view of the condition in which the cassette is attached to the lower case.

As shown in FIG. 3, an ink receiver unit 35 is provided in a region that is outside of the width of a sheet P to be carried (shorter side of the sheet P) and close to the left wall 39*b* of the frame 39. In addition, a maintenance unit 36 is provided in a region that is outside of the width of the sheet P to be carried and close to the right wall 39*c* of the frame 39.

The printing head 12, at fixed intervals, jets ink towards the ink receiver unit 35 to prevent clogging of nozzles. Ink jetted to prevent clogging is received by the ink receiver unit 35.

If the printing head 12 is not used, the carriage 13 supporting the printing head 12 moves to a position opposed to the maintenance unit 36. At this position, a capping unit 36*a* (See FIG. 4) covers a nozzle surface of the printing head 12 from the lower side, and prevents ink from drying in the nozzles of the printing head 12. In addition, recovery process, etc., for removing any air bubbles from a buffer tank (not shown) provided on the printing head 12 by actuating a suction pump (not shown) when necessary and sucking in ink from the nozzles is performed. In addition, when the carriage 13 moves in the lateral direction from the position opposed to the maintenance unit 36, it wipes out the nozzle surface with a wiper blade 36*b* (See FIG. 4) and cleans the printing head 12.

Then, the pair of feed-in rollers 20*a*, 20*b* for carrying a sheet P feeds from the cassette 5 into the printing unit 10 (i.e., onto the sheet support plate 11) and the pair of feed-out rollers 21*a*, 22*b* for pulling the printed sheet P from the printing unit 10 will be described.

As shown in FIG. 11, the pair of feed-in rollers 20*a*, 20*b* are arranged on the side of inlet of the printing unit 10. The pair of the feed-out rollers 21*a*, 21*b* are arranged on the side of exit of the printing unit 10. The both ends of the feed-in roller 20*a* and of the feed-out roller 21*a* are supported by the left wall 39*b* and the right wall 39*c* of the frame 39.

Of the pair of feed-in rollers 20*a*, 20*b*, the feed-in roller 20*a* located in the upper side is driven to rotate by the LE motor 42. The feed-in roller 20*b* located below the feed-in roller 20*a* is pressed with certain force to the feed-in roller 20*a*, and also rotates accordingly when the feed-in roller 20*a* rotates. The feed-in roller 20*a* is a feed-in drive roller 20*a*, while the feed-in roller 20*b* is a feed-in driven roller 20*b*.

Of the pair of feed-out rollers 21*a*, 21*b*, the feed-out roller 21*a* is also driven to rotate by the LF motor 42. The feed-out roller 21*b* located above the feed-out roller 21*a* is pressed with certain force to the feed-out roller 21*a*, and also rotates accordingly when the feed-out roller 21*a* rotates. The feed-out roller 21*a* is a feed-out drive roller 21*a*, while the feed-out roller 21*b* is a feed-out driven roller 21*b*. In addition, as shown in FIG. 6, the multi-function device 1 has a plurality of the feed-out driven rollers 21*b* attached to a roller holder 53. The plurality of feed-out driven rollers 21*b* is aligned in the Y axis direction with a predetermined interval. The feed-out driven rollers 21*b* are attached to the roller holder 53 via coil springs (not shown). The roller holder 53, to be described later, is movable relative to the frame 39.

The sheet P guided by the U-shaped sheet guide 9 is nipped by the pair of feed-in rollers 20*a*, 20*b*. The nipped sheet P is fed into the printing unit 10 (onto the sheet support plate 11) as the pair of feed-in rollers 20*a*, 20*b* rotates in the forward direction.

The sheet P printed at the printing unit 10 is further advanced by the pair of feed-in rollers 20*a*, 20*b* and reaches the pair of feed-out rollers 21*a*, 21*b*. The sheet P that reaches the pair of feed-out rollers 21*a*, 21*b* is nipped by the pair of feed-out rollers 21*a*, 21*b*. The nipped sheet P is pulled out from the printing unit 10 as the pair of feed-out rollers 21*a*, 21*b* rotate in the forward direction.

In addition, the pair of feed-in rollers 20*a*, 20*b* and the pair of feed-out rollers 21*a*, 21*b* rotate in synchronization. When the pair of feed-in rollers 20*a*, 20*b* rotates in the direction in which it carried the sheet P from the inlet side into the printing unit 10, the pair of feed-out rollers 21*a*, 21*b* rotates in the direction in which it pulls our the sheet P from the exit of the printing unit 10. At this time, the rotation direction of the pair of feed-in rollers 20*a*, 20*b* and that of feed-out rollers 21*a*, 21*b* is referred to as a forward direction.

The feed-in drive roller 20*a*, the feed-out drive roller 21*a*, the supply roller 7, and the maintenance unit 36 as described above are drive by one LF (for carrying sheets) motor 42. As shown in FIG. 4, the LF motor 42 is arranged in the vicinity of the left wall 39*b* of the frame 39. Power of the LF motor 42 is transmitted to the feed-in drive roller 20*a*, etc. by way of the gear groups 43. The gear groups 43 will be described with reference to FIG. 4 and FIG. 5.

A shaft of the LF motor 42 penetrates the left wall 39*b* of the frame 39 and extends to the outside of the frame 39. A pinion 43*a* is fixed to the shaft of the LF motor 42. The gears 43*b*, 43*c*, and 43*d* are rotatably supported on the outside of the left wall 39*b*.

The deceleration gear 43*b* engages with the pinion 43*a*. The feed-in drive roller 20*a* is fixed to the deceleration gear 43*b*. When the LF motor 42 rotates, the feed-in drive roller 20*a* rotates. As shown in FIG. 4, the gear 43*d* engages with the pinion 43*a* through the intermediate gear 43*c*. The feed-out drive roller 21*a* is fixed to the gear 43*d*. When the LF motor 42 rotates, the feed-out drive roller 21*a* rotates.

The deceleration gear 43*b* and the gear 43*d* rotate in opposite directions. Therefore, the feed-in drive roller 20*a* and the feed-out drive roller 21*a* also rotate in the opposite directions. The feed-n drive roller 20*a* is located on the upper side of the sheet P. while the feed-out drive roller 21*a* is located on the lower side of the sheet P. Thus, if the feed-in drive roller 20*a* and the feed-out drive roller 21*a* rotate in the opposite directions, the direction of feeding the sheet P by the feed-in drive roller 20*a* is identical to the direction of feeding the sheet P by the feed-out drive roller 21*a*.

Power of the LF motor 42 is transmitted from the end of the feed-in drive unit 20*a* to the supply unit 6 through a power transmission switching means 100 to be discussed later.

A rotary encoder 44 is provided on the deceleration gear 43*b* for detecting travel distance of a sheet P carried by the pair of feed-in rollers 20*a*, 20*b*. A CR motor 24 and the LF motor 42 are such configured that they can switch the rotation direction between in the forward and reverse directions.

In the multi-function device 1, the U-shaped sheet guide 9 corresponds to feed-in pathway for guiding sheets in the cassette 5 to the printing unit 10. To the left of the printing head 12 as shown in FIG. 11, that is, a pathway to which a printed sheet P is discharged from the printing unit 10 corresponds to a feed-out pathway. In normal single-side printing, a top sheet of stacked sheets contained in the cassette 5 is discharged (fed) by the supply unit 6. The discharged sheet is guided to the printing unit 10 by the feed-in pathway (U-shaped sheet guide 9). A sheet printed at the printing unit 10 is guided outside of the multi-function device 1 by the feed-out pathway.

Next, both side printing function of the multi-function device 1 will be described. During both side printing, the multi-function device 1 returns to the cassette 5 a sheet P whose one side is printed at the printing unit 10 and which is discharged from the printing unit 10. Passing through an opening 50 (described later) formed on the sheet support plate 11 arranged within the printing unit 10, the sheet P discharged (or pulled out) from the printing unit 10 is returned to the top of the stacked sheets in the cassette 5. As with the initial printing, the returned sheet P is fed to the printing unit 10 again by the supply unit 6 and the U-shaped sheet guide 9, where other side of the sheet is printed.

Referring to FIG. 7, FIG. 8, and FIG. 11 to FIG. 14, the sheet support plate 11 arranged opposed to the underside (the surface on which nozzles for jetting ink are formed) of the printing head 12 will be described. The sheet support plate 11 is the plate for supporting a sheet when the printing head 12 prints on the sheet. In addition, the sheet support plate 11 defines an interval (gap length) between the printing head 12 and the sheet during printing.

Figure 8:
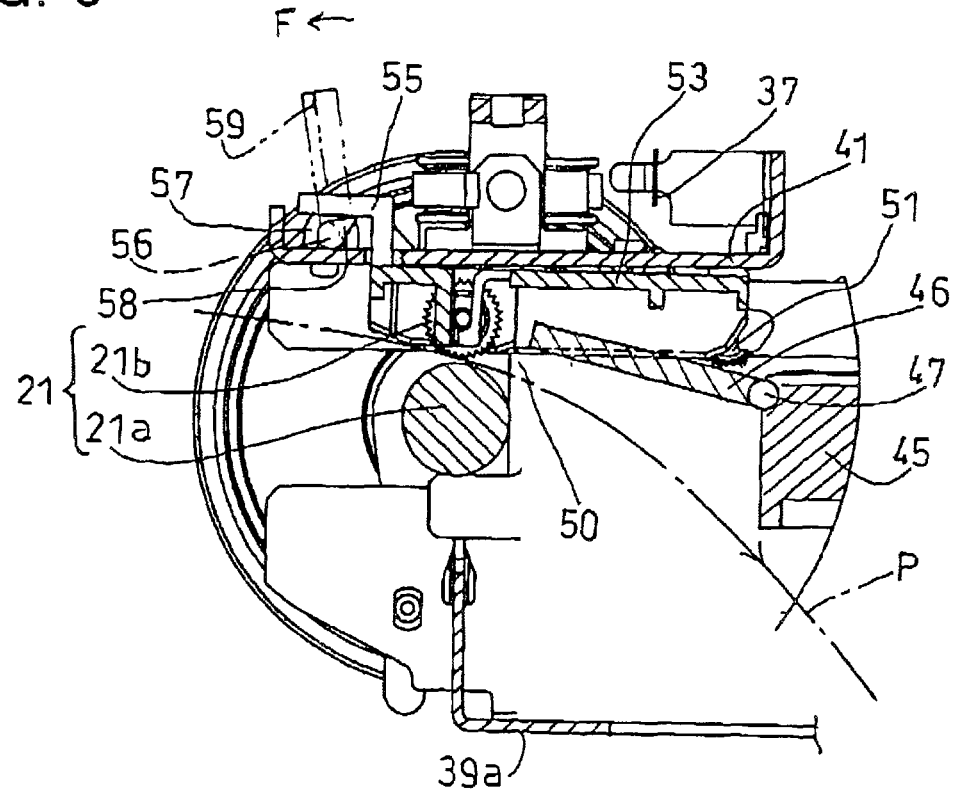
FIG. 8 is an enlarged sectional view of the periphery of the opening on the sheet support plate (with the opening opened).

The opening 50 is formed on the sheet support plate 11. The opening 50 is the opening through which the sheet P nipped by the pair of feed-out rollers 21*a*, 21*b* and pulled out from the printing unit 10 passes when returning to the cassette 6. As shown in FIG. 8, the opening 50 is a notch provided at the exit side end of the printing unit 10 of the sheet support plate 11. The opening 50 has three sides thereof surrounded by the sheet support plate 11, with the remaining one side surrounded by the feed-out roller 21*a*.

The sheet support plate 11 is comprised of a main plate 45 and a sub-plate 46 (cover plate). The main plate 45 is arranged in the upstream of the transport path of a sheet P (on the side of inlet of the printing unit 10), while the sub-plate 46 is arranged in the downstream of the transport path (on the side of exit of the printing unit 10). The main plate 45 and the sub-plate 46 are formed long in a direction orthogonal to the transport direction of the sheet P.

The main plate 45 is fixed to the bottom surface 39*a* of the frame 39 so as to be opposed to the base (the surface on which the nozzles are formed) of the printing head 12.

Figure 7:
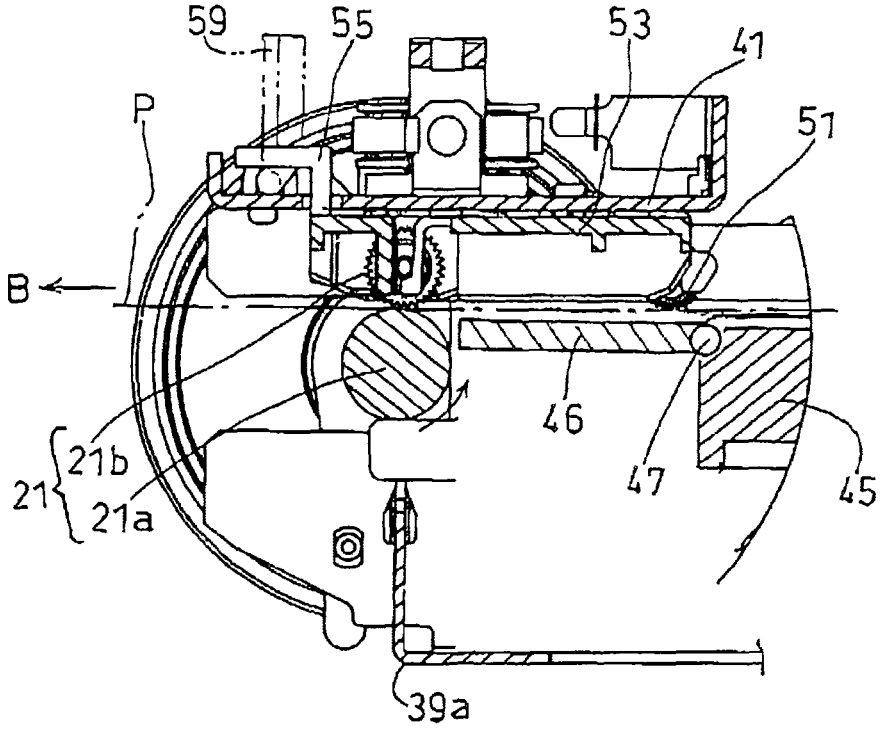
FIG. 7 is an enlarged sectional view of the periphery of the opening on the sheet support plate (with the opening closed).

The sub-plate 46 has both ends thereof in the longitudinal direction (Y axis direction) coupled to the frame 39 by a pin 47. As shown in FIG. 7, the pin 47 couples the end of the sub-plate 46 on the inlet side of the printing unit 10 to the frame 39. The sub-plate 46 is vertically rotatable around the pin 47. In other words, the sub-plate 46 can be inclined to the transport direction of the sheet P. The sub-plate 46 rotates vertically with the pin 47 as the rotating shaft by means of a solenoid 49 to be described later. The sub-plate 46 can be rotated (moved) between a position that forms an almost identical plane to the main plate 45 (See FIG. 7) and a position inclined to the main plate 45 (See FIG. 8), by means of the solenoid 49. The former position is referred to as a covering position, while the latter position is referred to as an uncovering position. The covering position is to close (cover) the opening 50, while the uncovering position is to open (uncover) the opening 50. More specifically, at the covering position, the top face of the sub-plate 46 forms one plane together with the top face of the main plate 45. This is to facilitate passage of the sheet over the sheet support plate 11. The uncovering position is to open the opening 50 toward the exit of the printing unit 10 (in other words, toward the feed-out rollers 21*a*, 21*b*). This is to facilitate guiding to the opening 50 of the sheet being back fed from the exit side of the printing unit 10. As shown in FIG. 11 to FIG. 14, the lower face of the end in the downstream of the transport direction of the sub-plate 46 is preferably formed like a taper. With it shaped like this, when the sub-plate 46 rotates so that the end in the downstream of the transport direction of the sub-plate 46 moves upward (namely, when the sub-plate 46 moves to the uncovering position), the opening 50 can be widely opened toward the exit of the printing unit 10. This makes it possible to smoothly guide the sheet P from the exit side of the printing unit 10 to the lower part of the arm 6*a*.

The sheet P guided from the exit side of the printing unit 10 to the cassette 5 through the opening 50 and lower part of the arm 6*a* is fed toward the printing unit 10 once again by the supply unit 6 as described above. The fed sheet P is guided to the printing unit 10 by the U-shaped sheet guide 9. It is carried from the U-shaped sheet guide 9 into the printing unit 10 again by the pair of feed-in rollers 20*a*, 20*b*. Thus, graphic patterns are printed on both sides of the sheet P.

Then, the operation of the multi-function device 1 during both side printing of the sheet P will be described in detail with reference to FIG. 11 to FIG. 14.

Figure 12:
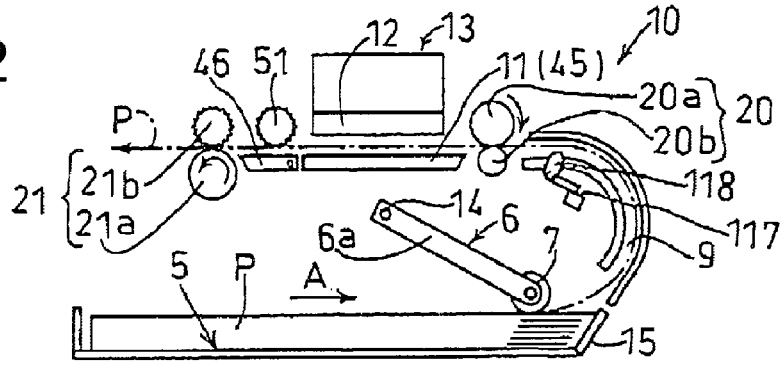
Figure 13:
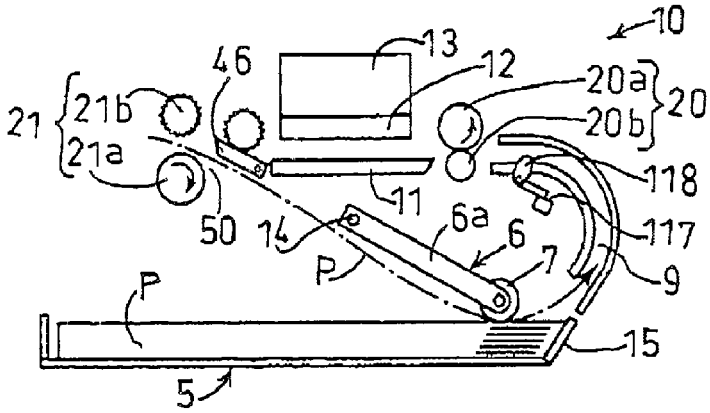
Figure 14:
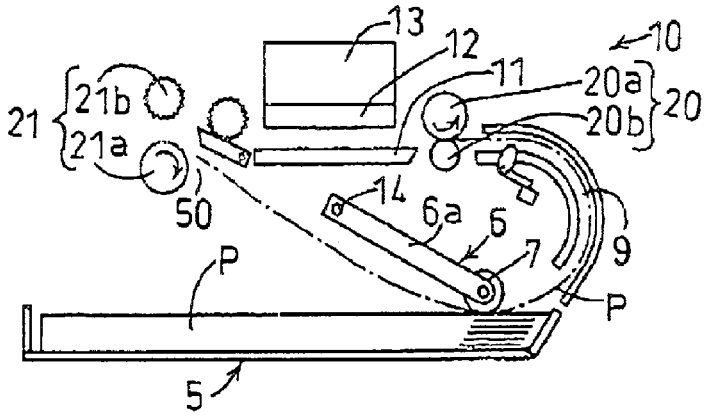

As shown in FIG. 11, the sheet P on top of the stacked sheets in the cassette 5 is fed (discharged) by the supply unit 6 toward the printing unit 10. The discharged sheet P is guided by the U-shaped sheet guide 9. The sheet P is nipped by the pair of feed-in rollers 20*a*, 20*b* at the end of the U-shaped sheet guide 9. The nipped sheet P is carried into the printing unit 10 and positioned on the sheet support plate 11 as the pair of feed-in rollers 20*a*, 20*b* rotates in the forward direction. At this time, the sub-plate 46 is located at the covering position. The printing head 12 prints on one side of the sheet P located on the sheet support plate 11 in the printing unit 10. Similar to the pair of feed-in rollers 20*a*, 20*b*, the feed-out rollers 21*a*, 21*b* also rotate in the forward direction. Thus, when reaching the pair of feed-out rollers 21*a*, 21*b*, the one side printed sheet P carried into the printing unit 10 by the pair of the feed-in rollers 20*a*, 20*b* is nipped by the pair of feed-out rollers 21*a*, 21*b*. The one side printed sheet P nipped by the pair of feed-out rollers 21*a*, 21*b* is pulled out from the print area 10 as the pair of feed-out rollers 21*a*, 21*b* rotates in the forward direction. When the back end of the one side printed sheet P reaches the pair of feed-out rollers 21*a*, 21*b*, the pair of feed-out rollers 21*a*, 21*b* stop rotating. Then, the pair of feed-out rollers 21*a*, 21*b* rotates in the reverse direction. At time same time, the sub-plate 46 moves to the uncovering position. When the pair of feed-out rollers 21*a*, 21*b* rotates in the reverse direction, the nipped sheer P (the one side printed sheet P) is back fed from the exit side to the inlet side of the printing unit 10. The back fed sheet P abuts the lower surface of the sub-plate 46 and the travel direction thereof is oriented downward. Thus, the one side printed sheet P does not proceed to the inlet side of the printing unit 10 and proceeds down to the printing unit 10 (FIG. 12). Through the opening 50 and under the arm 6*a*, the one side printed sheet P is returned to the top of the stacked sheets in the cassette 5. The one side printed sheer P returned to the cassette 5 is fed toward the printing unit 10 again by the supply unit 6. The discharged one side printed sheet P is guided by the U-shaped sheet guide 9 and transported into the printing unit 10 with the same manner of initial printing. The other side of the one side printed sheet P is printed (FIG. 13 and FIG. 14). While the one side printed sheet P is passing through the U-shaped sheet guide 9, it is flipped. Thus, out of the surfaces of the sheet P, the surface facing upward when initially passing through the printing unit 10 and printed thereon is reversed to face downward when passing though the U-shaped sheet guide 9 once again. This could enable double-side printing of the sheet P.

Now a mechanism for moving the sub-plate 46 will be described. In the lower part of the sub-plate 46 is provided a vertically slidable rod (not shown) that can be moved up and down by the solenoid 49. Moving the rod up and down can rotate the sub-plate 46. This can open and close (uncover and cover) the opening 50 of the sheet support plate 11. The rod may be arranged above the sub plate 46 and the lower end of the rod may be coupled to the sub-plate 46. Even such the configuration can rotate the sub-plate 46.

A spur 51 is arranged between the printing head 12 and the feed-out rollers 21*a*, 21*b*. The spur 51 is arranged having a predetermined gap to the top face of the sub-plate 46 (See FIG. 7, FIG. 8, and FIG. 11 to FIG. 14). The spur 51 avoids floating of the sheet P from the sheet support plate 11 (the main plate 45 and the sub-plate 46). This prevents the surface of the sheet P from being contaminated as a result of contacting with the nozzles of the printing head 12.

Next a capability of releasing the force of the pair of feed-out rollers 21*a*, 21*b* of nipping the sheet P will be described with reference to FIG. 6 to FIG. 10.

The force of nipping the sheet P of the pair of feed-out rollers 21*a*, 21*b* can be released by separating the rollers 21*a* and 21*b* that press each other.

As described above, the feed-out driven roller 21*b* is rotatably attached to the roller holder 53. The roller holder 53 is coupled to the bottom surface 39*a* of the frame 39 so that it can move up and down. The roller holder 53 is arranged in proximity to the lower surface of the front side guide plate 41. In the tabular roller holder 53 made of synthetic resin, a plurality of feed-out driven rollers 21*b* are arranged at predetermined intervals along the rotation axis line of the feed-out drive roller 21*a*. Hooks 55*a* are provided at both ends of the roller holder 53. In addition, hooks 55*b* are provided at the both edges of the main plate 45 fixed to the bottom surface 39*a*. The hooks 55*a* and 55*b* are coupled by a coil spring 54. The coil spring 54 biases the roller holder 53 downward. With this, the feed-out driven rollers 21*b* attached to the roller holder 53 are always biased to the feed-out drive roller 21*a*. The biasing force allows the sheet to be nipped between the pair of feed-out rollers 21*a*, 21*b*.

To the edge in the downstream of the transport direction of the sheet P among the top faces of the roller holder 53 are attached L-shaped members 55 along Y axis direction at predetermined intervals. The L-shaped members penetrate the front side guide plate 41. The L-shaped members 55 are arranged so that one side thereof is opposed to the top face of the front side guide plate 41 (See FIG. 6 to FIG. 8). At the edge in the downstream of the transport direction among the top faces of the front side guide plate 41, a pivot shaft 56 extending along the Y axis direction is pivotally supported to the center of a shaft bush 57. A droplet boost-up cam 58 is fixed to the pivot shaft 56 (See FIG. 7 and FIG. 8). In addition, a contact lever 59 extending upward in the vicinity of the maintenance unit 36 is fixed to the pivot shaft 56 (See FIG. 6 to FIG. 8). When the carriage 13 moves along the main scanning direction (Y axis direction) and enters the maintenance unit 36 from the print area (when it travels in the arrow E direction in FIG. 6), and moves in the direction in which it exits from the maintenance unit 36 into the print area (the arrow C direction in FIG. 6), a rear end face 13*c* (See FIG. 6) of the carriage 13 presses the contact lever 59 and turns the pivot shaft 56 anticlockwise (the arrow F direction in FIG. 8). By this, the cam 58 lifts the L-shaped member 55 upward. Then, the roller holder 53 rotates clockwise (FIG. 8) against the biasing force of the coil spring 54, thereby separating all the feed-out driven roller 21*b* from the top face of the feed-out drive roller 21*a*. With this, the pair of feed-out rollers 21*a*, 21*b* releases the force of nipping the sheet P.

In the following, referring to FIG. 15 to FIG. 33, configuration of the power transmission switching means 100 will be described. The power transmission switching means 100 transmits power of the LF motor 42 to the supply unit 6 or the maintenance unit 36. The power transmission switching means 100 can selectively switch the following 4 types of power transmission modes:

(a) Intermittent feeding mode: This mode is the power transmission mode for intermittently feeding sheets from the cassette 5 to the printing unit 10. The intermittent feeding mode is used for printing on sheets with a high degree of accuracy.

(b) Continuous feeding mode: This mode is the power transmission mode for continuously feeding sheets from the cassettes 5. The continuous feeding mode is used when continuously printing on a plurality of sheets at high speed.

(c) Return node: This mode is the power transmission mode for returning to the cassette 5 again a sheet one side of which has been printed and pulled from the printing unit 10. This mode is used when printing on both sides of a sheet.

(d) Maintenance mode: This mode is the power transmission mode for moving to the maintenance unit 36 the carriage 13 that fixes the printing head 12. The maintenance mode is used when cleaning the printing head 12.

Unless the power transmission switching means 100 switches modes, a selected mode is maintained.

As described above, power of the LF motor 42 capable of rotating in the forward and reverse directions is transmitted to the pinion 43*a* and the deceleration gear 43*b* attached to the feed-in driver roller 20*a*. In addition, power of the LF motor 42 is transmitted from the pinion 43*a* to the gear 43*c* attached to the feed-out drive roller 21*a* by way of the deceleration gear 43*b*. In fact, the feed-in drive roller 20*a* and the feed-out drive roller 21*a* simultaneously rotate by the power of the LF motor 42.

Figure 31:
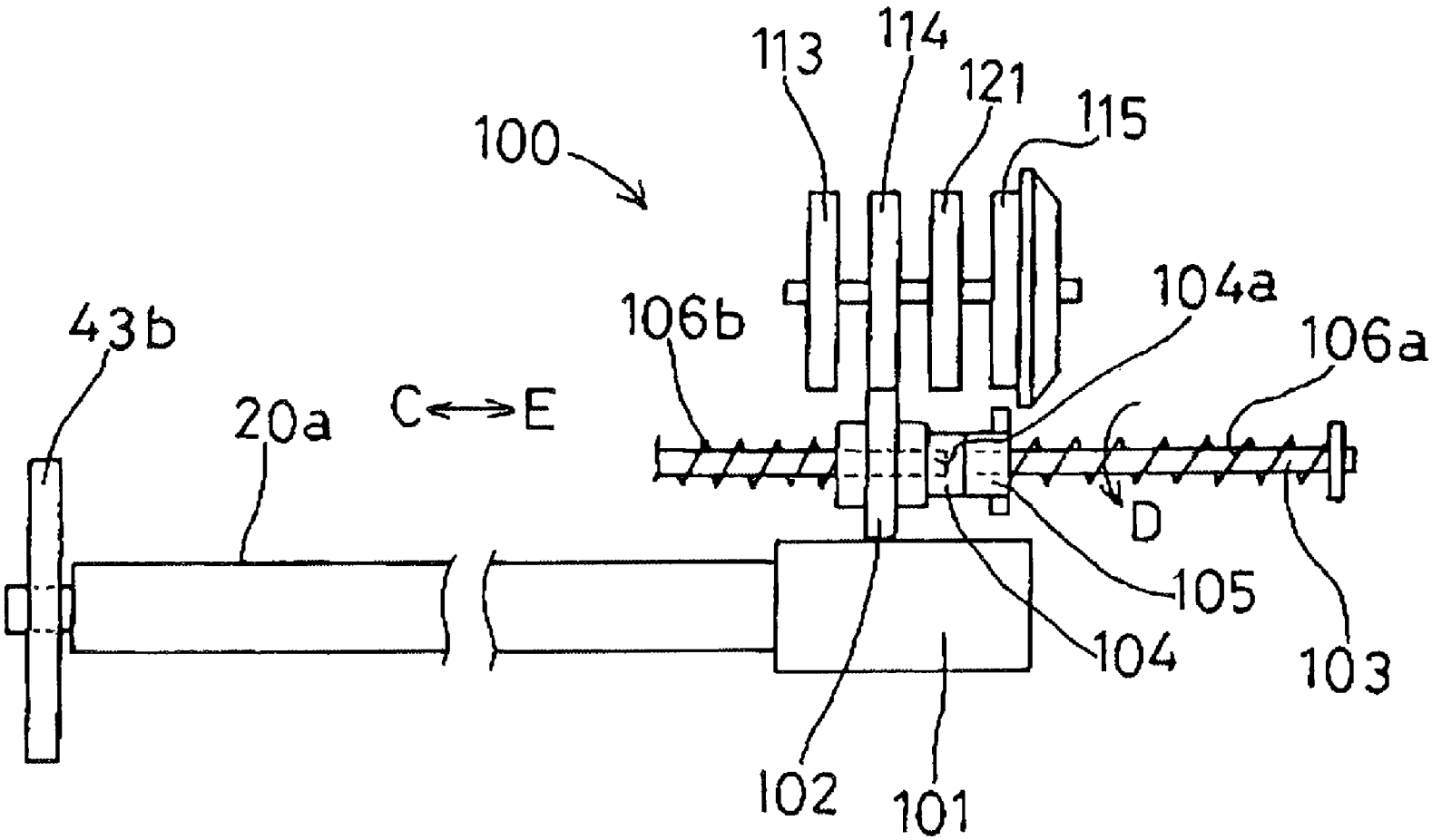
FIG. 31 is a schematic view of a power transmission switching means.

As shown in FIG. 31, the power (torque) of the LF motor 42 is transmitted to the feed-in drive roller 20*a* via deceleration gear 43*b*. The gear 101 is fixed to a right end section of the feed-in drive roller 20*a* (upper section of the maintenance unit 36). A switching gear 102, which is always engaged with the gear 101, is provided at a position adjacent to the gear 101. The switching gear 102 is slidable with respect to a spindle 103 extending in the Y-axis direction.

A first block 104 (first slider) and a second block 105 (second slider) are slidable with respect to the spindle 103. The switching gear 102, first block 104, and second block 105 are slidable with respect to the spindle 103 independently of other members. The first block 104 contacts with or separates from the switching gear 102. The second block 105 contacts with or separates from the first block 104. The switching gear 102 and the first block 104 are rotatable with respect to the spindle 103, and the second block 105 is prohibited to rotate with respect to the spindle 103.

A surface with which the first block 104 and the second block 105 contact is inclined to the spindle 103. When the second block 105 approaches the first block 104, the first block 104 rotates around the spindle 103. A connecting lever 104*a* protruding upward is fixed to the first block 104. When the second block 105 approaches the first block 104 and the first block 104 rotates around the spindle 103, the connecting lever 104*a* moves from top to bottom, in FIG. 33.

As shown in FIG. 18 through FIG. 21, a plate-like engaging plate 104*b* is provided between a base section 104*c* of the first block 104 and the connecting lever 104*a* extending from the base section 104*c* in a radial outer direction. In the second block 105, a section facing the engaging plate 104*b* in the base section 105*a* is provided with a notch section 105*b* in which the engaging plate 104*b* is buried. One surface of the notch section 105*b* is formed as an abutting surface 105*c* inclining from the center of radius of the base section 105*a* to the outside the radius of same. Further, the second block 105 is provided with a pair of corner sections 105*d* extending in the radial outer direction from the base section 105*a*. The pair of corner sections 105*d* is provided so as to be able to abut on a bottom surface of the front side guide plate 41 on the downstream side so that the second block 105 does not rotate around the spindle 103. The base section 104*c* of the first block 104 is formed so as to be buried in an inner diameter of the base section 105*a* of the second block 105.

Figure 19:
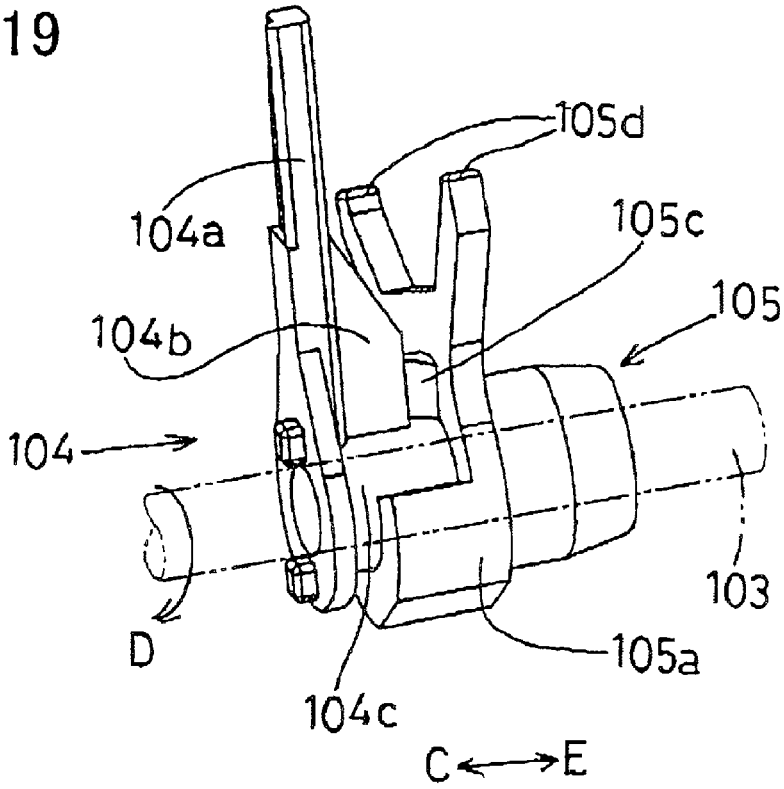
FIG. 19 is a perspective view of condition in which the first and second blocks are combined.
Figure 20:
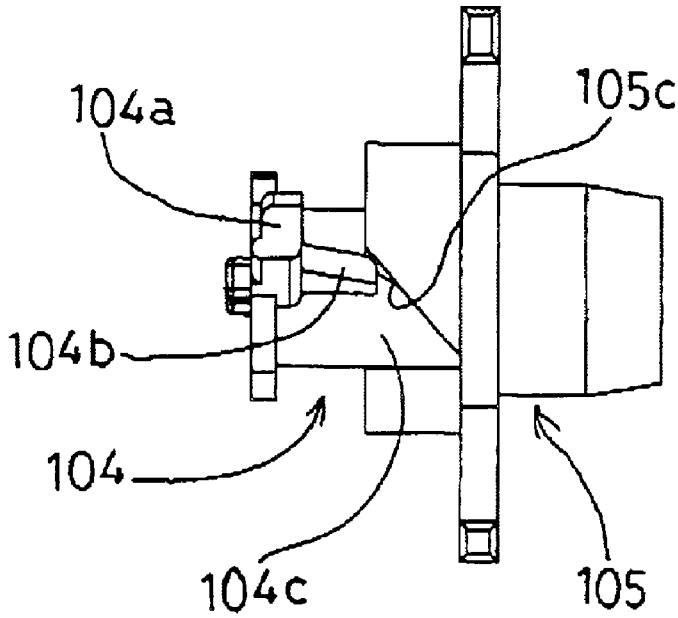
FIG. 20 is a front view of condition in which the first and second blocks are shallowly engaged.
Figure 21:
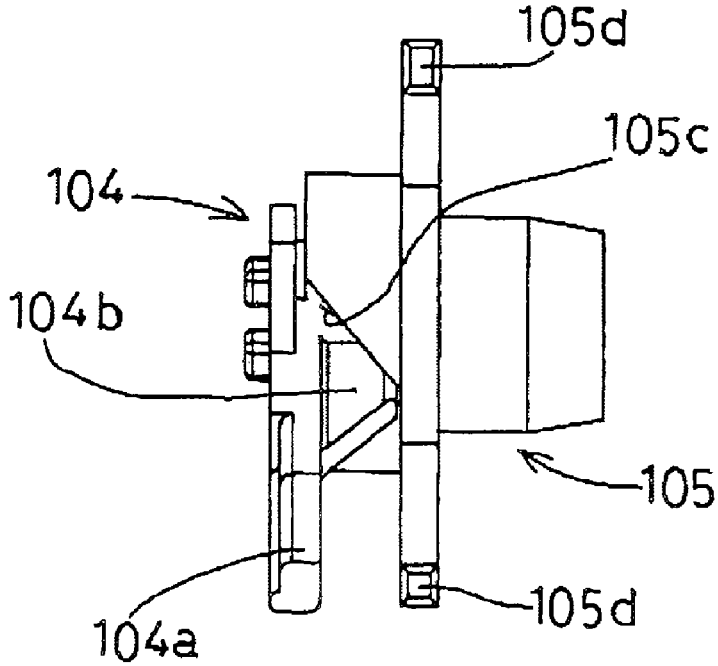
FIG. 21 is a front view of condition in which the first and second blocks are deeply engaged.
Figure 22:
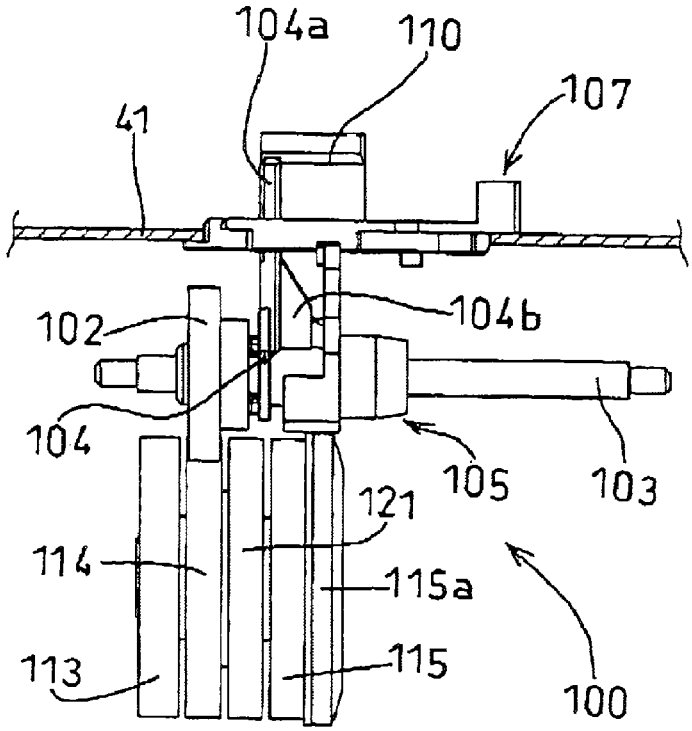
FIG. 22 is a front view showing power transmission while a sheet is fed in continuous feeding mode (second mode).
Figure 23:
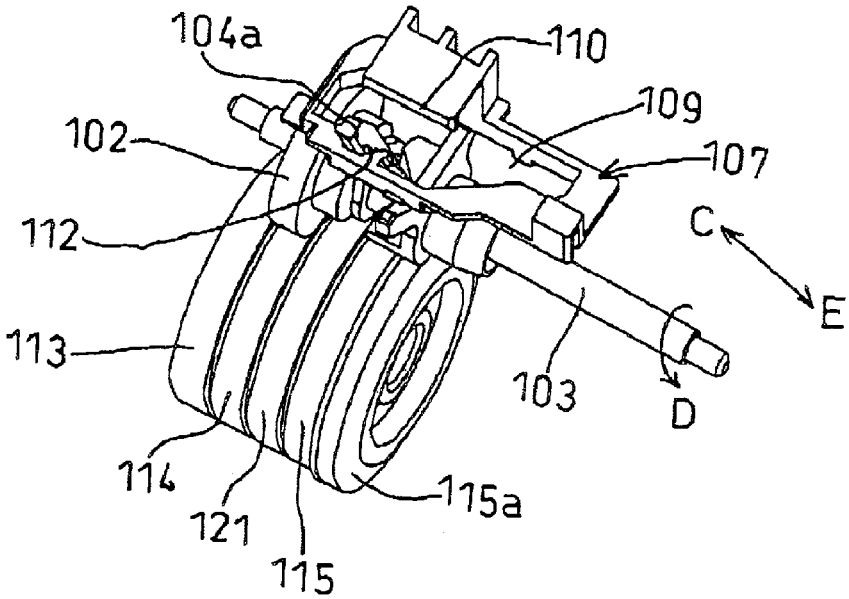
FIG. 23 is a perspective view showing power transmission while a sheet is fed in the continuous feeding mode (second mode).
Figure 24:
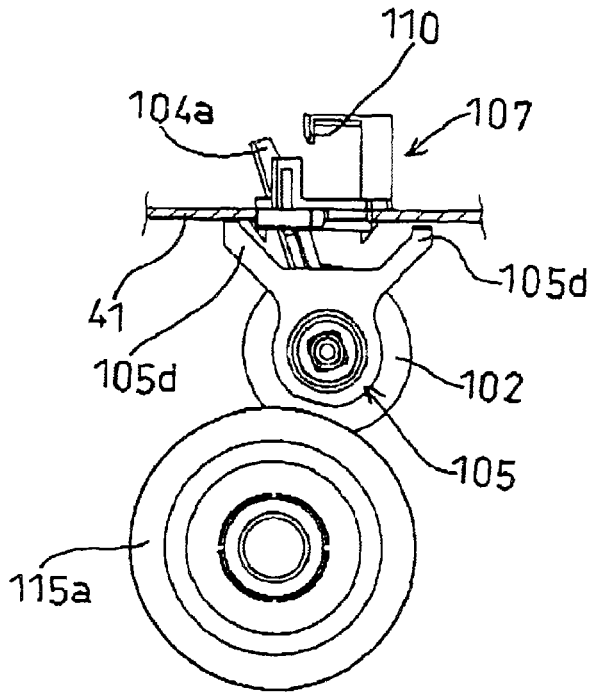
FIG. 24 is a side view showing power transmission while a sheet is fed in the continuous feeding mode (second mode).
Figure 25:
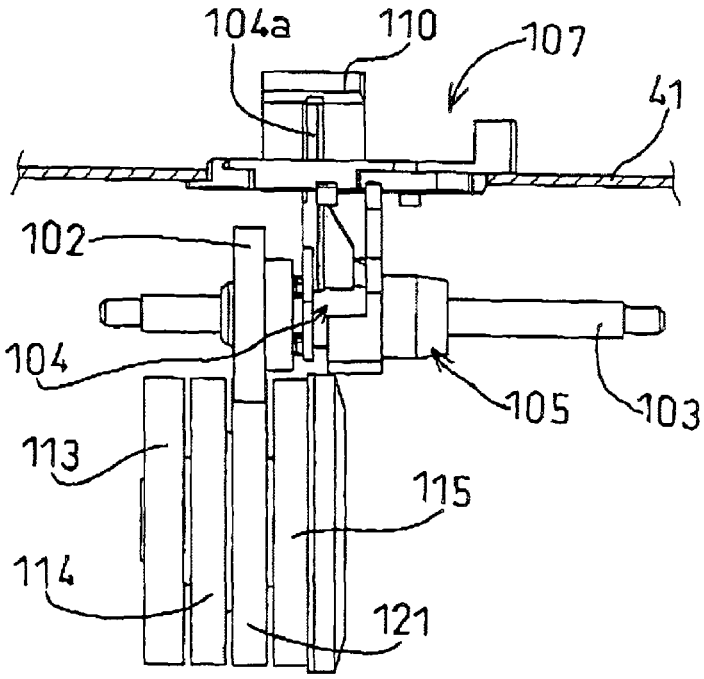
FIG. 25 is a front view showing power transmission in return mode.
Figure 26:
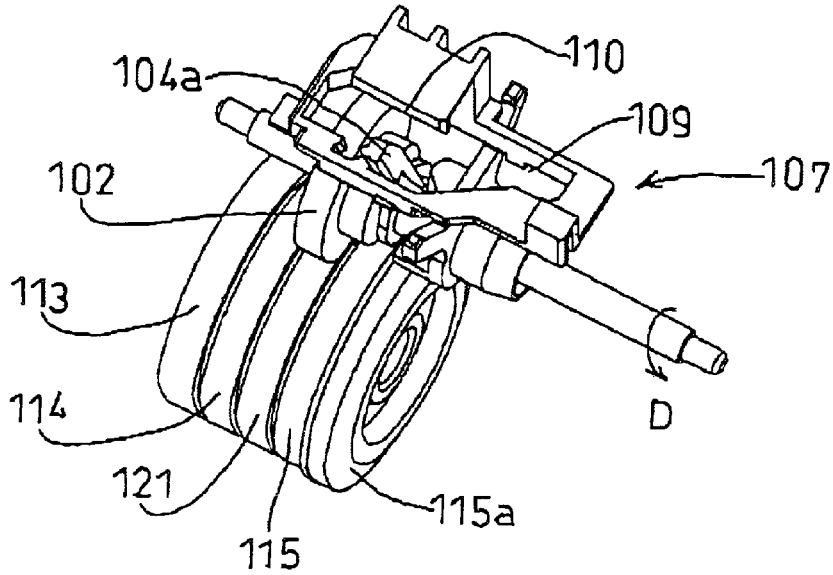
FIG. 26 is a perspective view showing power transmission in the return mode.
Figure 27:
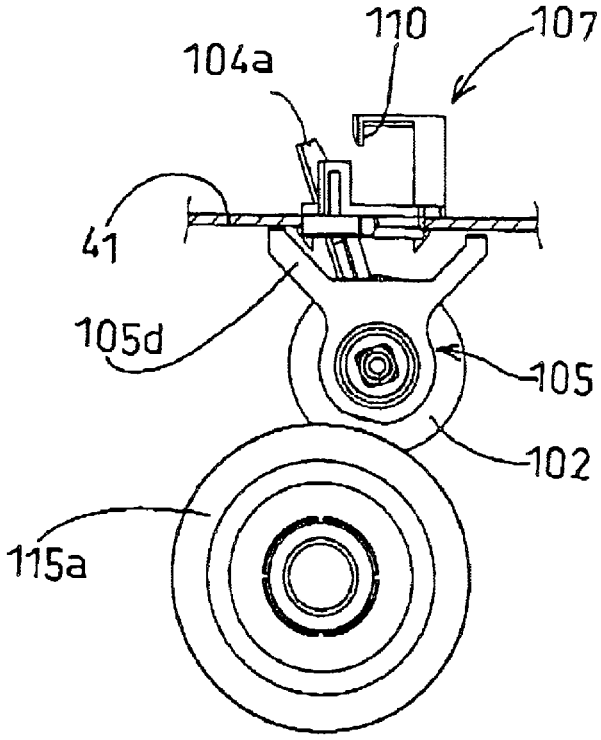
FIG. 27 is a side view showing power transmission in the return mode.

During a period between a state where the first block 104 and the second block 105 approach each other and the engaging plate 104*b* abuts against a section on the outer radius side in the abutting surface 105*c* of the notch section 105*b* (see FIG. 20) and a state where the space between the first block 104 and the second block 105 becomes narrow and the engaging plate 104*b* abuts against a section on the center side of the radius in the abutting surface 105*c* of the notch section 105*b* (see FIG. 21), the position of the first block 104 is forcibly caused to rotate in the direction of the arrow D (see FIG. 19). If the first block 104 rotates, the connecting lever 104*a* also rotates When the first block 104 rotates in the direction of the arrow D, the connecting lever 104*a* also rotates in the direction of the arrow D.

As shown in FIG. 31, a first biasing spring 106*a* is disposed around the spindle 103. The first biasing spring 106*a* presses the second block 105 in the direction of the arrow C. A second biasing spring 106*b* is disposed around the spindle 103. The second biasing spring 106*b* presses the switching gear 102 in the direction of the arrow E. The biasing force of the first biasing spring 106*a* is larger than the biasing force of the second biasing spring 106*b*.

Figure 33:
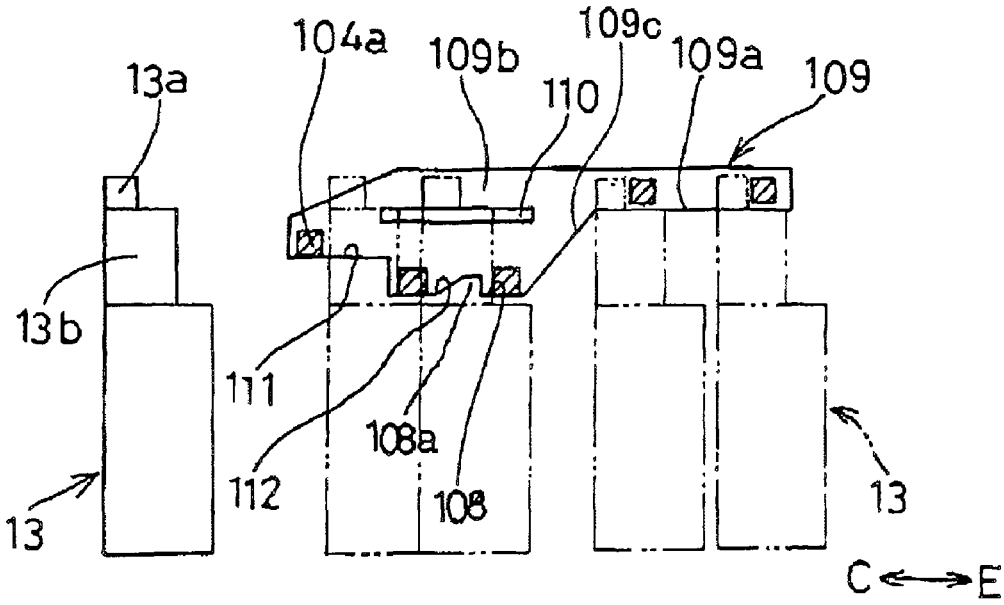
FIG. 33 is a plan view showing a state in which the modes are switched by the power transmission switching means

As shown in FIG. 33, a first engaging step section 13*a* and a second engaging step section 13*b* are formed in the carriage 13. When the carriage 13 moves in the direction of the arrow E, the connecting lever 104*a* of the first block 104 is engaged with either the first engaging step section 13*a* or the second engaging step section 13*b*.

As shown in FIG. 4, a guide block 107 is fixed to the frame 39. A guide groove 109 is formed in the guide block 107, and the connecting lever 104*a* of the first block 104 is buried in the guide groove 109. As shown in FIG. 33, the guide groove 109 comprises a linear groove section 109*a* which is elongated in the direction indicated by the arrows C and E (Y axis), and an circular groove section 109*b* which is communicated with a left end section of the linear groove section 109*a* via a connecting inclined surface 109*c*. A regulating piece 110 which extends downward from an upper section of the guide block 107 is inserted in a central section of the circular groove section 109*b*. The regulating piece 110 is elongated in the direction indicated with the arrows C and E. The circular groove section 109*b* is provided with a stair-like first set section 111, second set section 112, and third set section 108. An inclined convex section 108*a* is provided between the second set section 111 and the third set section 108. These three set sections 111, 112, and 108 are, as a whole, referred to as a maintaining section.

As shown in FIG. 33, when the carriage 13 moves in the direction of the arrow E and contacts with the guide groove 109, the first engaging step section 13*a* or the second engaging step section 13*b* of the carriage 13 is engaged with the connecting lever 104*a* of the guide groove 109. As a result, the switching gear 102, the first block 104, and the second block 105 are caused to slide along the spindle 103 in the direction of the arrow C or E. Switching the operation modes by the power transmission switching means 100 will be described.

Figure 32:
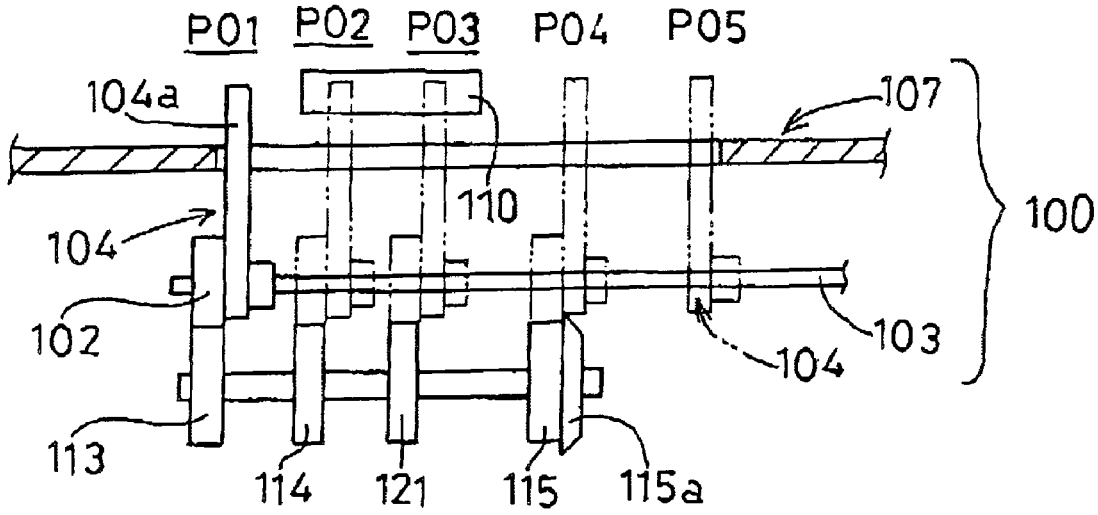
FIG. 32 is a front view schematically showing a stare in which the modes are switched by the power transmission switching means

As shown in FIG. 32, 33, when the carriage 13 is located in a position facing the sheet P, the carriage 13 is away from the maintenance unit 36 in the direction of arrow C and does not press the connecting lever 104*a* in the direction of the arrow E. In this state, the first biasing spring 106*a* causes the second block 105, first block 104 and switching gear 102 to slide along the spindle 103 in the direction of the arrow C. Then, the connecting lever 104*a* rotating in the direction of the arrow D is engaged with the first set section 111. This position is called "position 1" (Po1). At this moment, the switching gear 102 is engaged with the intermittent feeding gear 113 (see FIG. 15-17). This state (the switching gear 102 is engaged with the intermittent feeding gear 113) is called "the intermittent feeding mode".

When the carriage 13 moves in the direction of the arrow E, the first engaging step section 13*a* of the carriage 13 presses the connecting lever 104*a* in the direction of the arrow E. When the connecting lever 104*a* reaches the second set section 112, the connecting lever 104*a* is engaged with the second set section 112. This position (the connecting lever 104*a* is positioned at the second set section 112) is called "position 2" (Po2). At this moment, the switching gear 102 is engaged with the continuous feeding gear 114 (see FIG. 22-24). This state (the switching gear 102 is engaged with the continuous feeding gear 114) is called "the continuous feeding mode".

When the carriage 13 further moves in the direction of the arrow E, the first engaging step section 13*a* of the carriage 13 presses the connecting lever 104*a* in the direction of the arrow E. The pressed abutting piece 104*a* climbs over a convex section 108*a* and reaches the third set section 108, the connecting lever 104*a* is engaged with the third set section 108. This position (the connecting lever 104*a* is positioned at the third set section 108) is called "position 3" (Po3). At this moment, the switching gear 102 is engaged with the idle gear 121 (see FIG. 25-27). This state (the switching gear 102 is engaged with the idle gear 121) is called "the return mode". The idle gear 121 have no engaging gear except the switching gear 102. Therefore, the power of LF motor 42 is not transmitted to the drive shaft 14. The supply roller 7 that is fixed to the drive shaft 14 becomes free to rotate with respect to the LF motor 42.

When the carriage 13 further moves from position 3 (Po3) in the direction of the arrow E, the connecting lever 104*a* moves along with a connecting inclined surface 109*c* formed in the guide groove 109. The connecting inclined surface 109*c* guides the connecting lever 104*a* from the circular groove section 109*b* to the linear groove section 109*a*, while the connecting lever 104*a* moves along with the connecting inclined surface 109*c*, the engaging partner of the connecting lever 104*a* changes from the second engaging step section 13*b* to the first engaging step section 13*a*. When the connecting lever 104*a* reaches the position of the linear groove section 109*a* (this position is called "position 4" (Po4)), the switching gear 102 is engaged with the maintenance gear 115 (see FIG. 28-30).

The switching gear 102, the intermittent feeding gear 113, the continuous feeding gear 114, the idle gear 121 and the maintenance gear 115 are all spur gears. When the switching gear 102 gets to engage with one of those spur gears, phase of teeth may not synchronize. Therefore, when switching the position of the pressed abutting piece 104*a*, the switching gear 102 is slightly rotated in the reverse direction in order to make engage smoothly.

The bevel gear 115*a* having a large diameter is fixed to a side surface of the maintenance gear 115.

Figure 28:
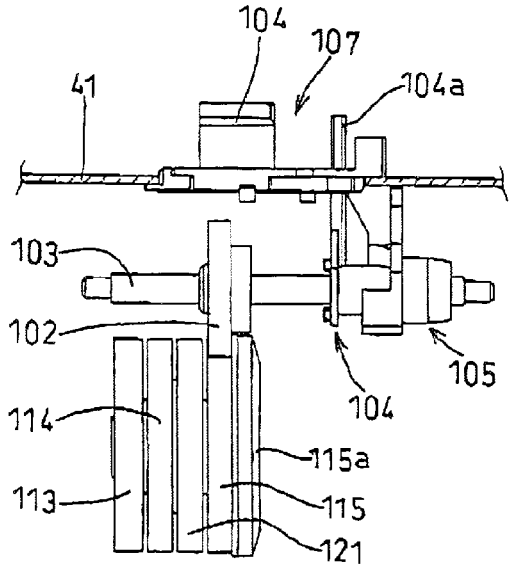
FIG. 28 is a front view showing power transmission in maintenance operation mode.
Figure 29:
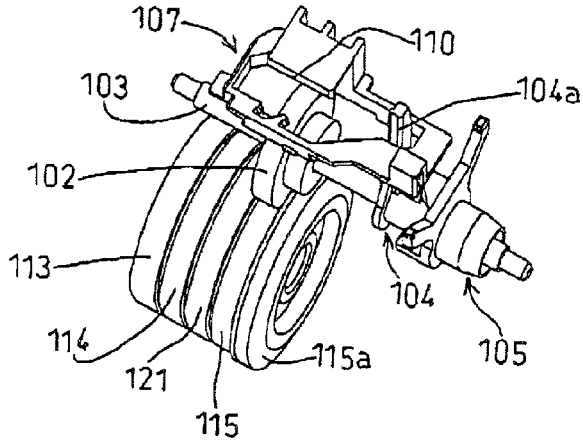
FIG. 29 is a perspective view showing power transmission in the maintenance operation mode.
Figure 30:
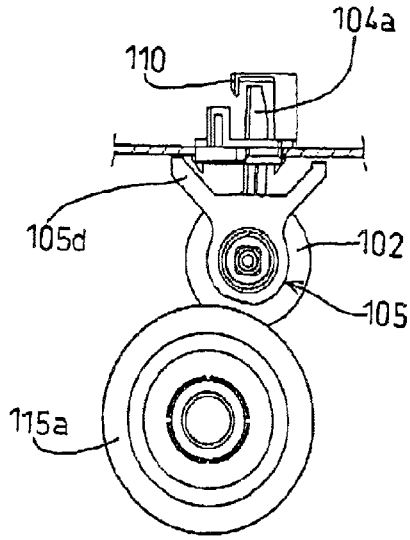
FIG. 30 is a lateral view showing power transmission in the maintenance operation mode.

When the carriage 13 further moves from position 4 (Po4) in the direction of the arrow E, the side surface of the switching gear 102 contacts with the bevel gear 115*a*. The switching gear 102 is prevented to move in the direction of the arrow E. As a result, the switching gear 102 is detached from the first block 104 and is kept to engage with the maintenance gear 115 (FIG. 28-30). On the other hand, the pressed abutting piece 104*a* is pushed by the second engaging step section 13*b* of the carriage 13 and reaches end portion (most right side in FIG. 33) of the linear groove section 109*a*. This position (the pressed abutting piece 104*a* is positioned at the end portion of the linear groove section 109*a*) is called "position 5" (Po5). This state is called "the maintenance mode".

Contrary to the above state, when the carriage position 13 moves from the position 5 (Po5) in the direction of the arrow C, the connecting lever 104*a* moves from the linear groove section 109*a* to the circular groove section 109*b*. At this moment, the connecting lever 104*a* is received by the first engaging step section 13*a* of the carriage 13, thus the connecting lever 104*a* does not slides on the connecting inclined surface 109*c* but slides on the regulating piece 110 in the direction of the arrow C. Therefore, the connecting lever 104*a* abuts on a left inclined surface of the circular groove section 109*b* shown in FIG. 33 while sliding on the regulating piece 110, thereafter moves along the left inclined surface and then is engaged with the first set section 111. In this manner, the connecting lever 104*a* repeats the cycle of moving from the position 1 to the position 4.

The position 5 (Po5) is called "the home position (original position)". The home position is both stand-by position and maintenance position. At this home position, the capping unit 36*a* covers nozzle surfaces of the printing head 12 from the lower side. A recovery process, etc., for removing any air bubbles from a buffer tank (not shown) provided on the printing head 12, for selectively sucking in ink from the nozzles by actuating a suction pump (not shown) by the LF motor 42 are performed. In addition, when the carriage 13 moves in the lateral direction from the position of the maintenance unit 36 to the printing area (left direction in FIG. 6), at the position 4 (Po4), the capping unit 36*a* uncovers nozzle surfaces and sucking in without ink is performed while wiping out the nozzle surface with a cleaner (wiper blade). In a state where power is not applied to the multifunction device 1, the carriage 13 stops at an upper position (position 5 (Po5)) of the maintaining unit 36 and the nozzles of the printing head are covered by the capping unit 36*a*.

Figure 34:
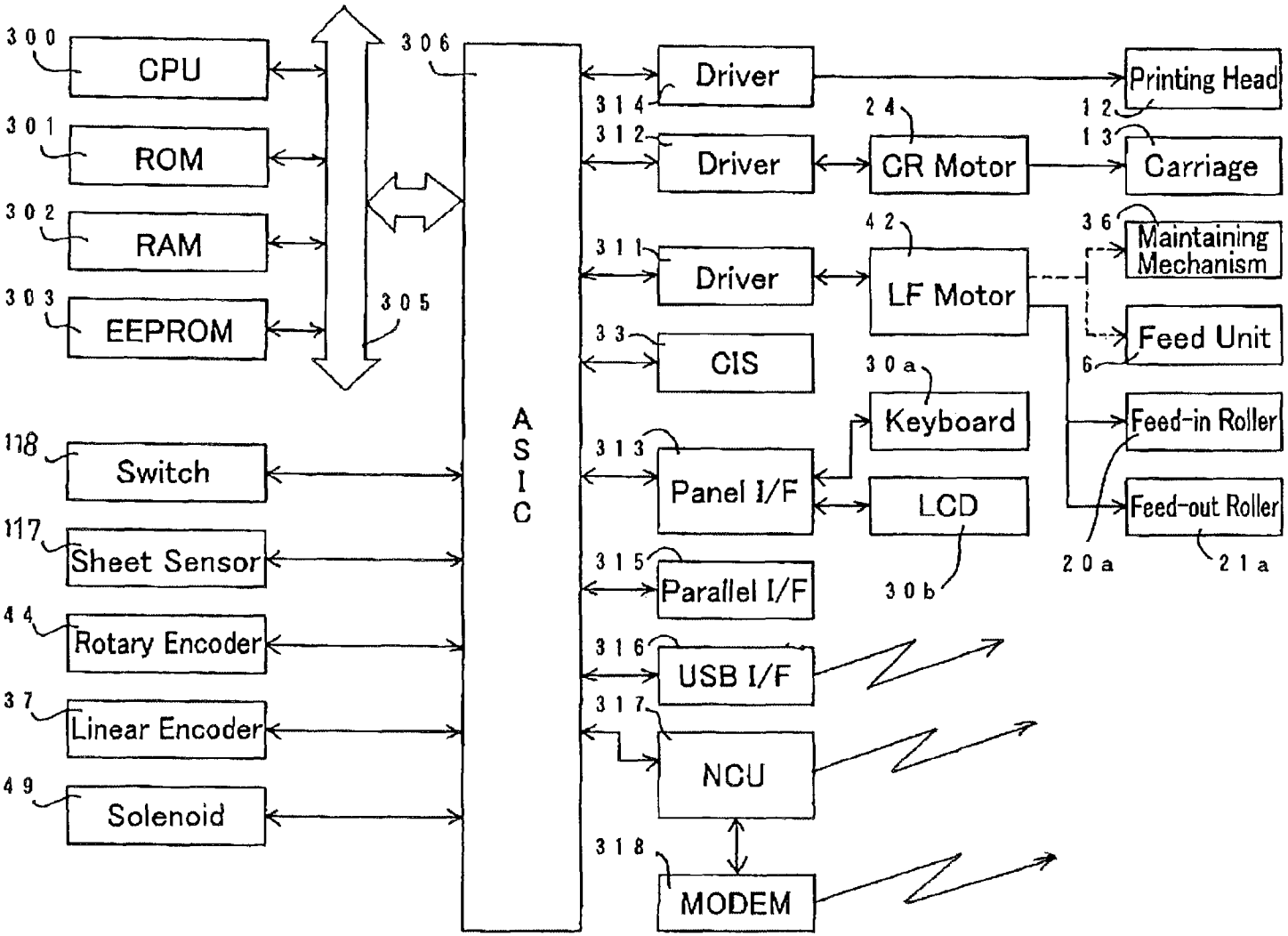
FIG. 34 is a functional block diagram of a control device.

A control section (controller or control means) of the multifunction device 1 is described next with reference to FIG. 34. The control section is for controlling the entire operation of the multifunction device 1.

The control section is configured as a computer comprising mainly as a CPU 300, ROM 301, RAM 302, and BEPROM 303, and is connected to an application specific integrated circuit (ASIC) 306 via a bus 305.

The ROM 301 has stored therein a program and the like for controlling various operations of the multifunction device 1, and the RAM 302 is used as a storage region for temporarily storing various data items which are used when the CPU 300 executes these programs.

An NCU (Network Control Unit) 317 is connected to the ASIC 306, and a communication signal which is inputted from a public circuit via the NCU 317 is demodulated by a MODEM 318 and then inputted to the ASIC 306. Furthermore, when the ASIC 306 transmits image data to the outside by means of facsimile transmission or the like, the image data is modulated by the MODEM 318 and then outputted to the public line via the NCU 317.

The ASIC 306 generates a phase excitation signal and the like which are communicated with, for example, the LF motor 42 in accordance with a command from the CPU 300. These signals are provided to a drive circuit 311 of the LF motor 42 or a drive circuit 312 of the CR motor 24, and a drive signal is communicated to the LF motor 42 or CR motor 24 via the drive circuit 311 or drive circuit 312 to control forward and reverse operation, stoppage and the like of the LF motor 42 and CR motor 24.

Further, the scanner device 33 (CIS, for example) for reading images or characters on a script, a panel interface 313 for performing transmission of signals with a keyboard 30*a* and a liquid crystal display (LCD) 31 of the operation panel 30, a parallel interface 315 and a USB interface 316 for performing transmission of data with external equipment such as a personal computer via a parallel cable or USB cable and the like are connected to the ASIC 306

Moreover, a switch 118 for detecting a rotation position of a cam (not shown) of the maintenance unit 36, the sheet sensor 117 for detecting the front edge position and the back edge position of the sheet P when the sheet P is fed so as to approach the printing region via the U-shaped sheet guide 9, the rotary encoder 44 for detecting the amount of rotation of the feed-in roller 20*a*, the linear encoder 37 for detecting the position (present position) of the carriage 13 in the Y-direction, and the like are connected to the ASIC 306.

A driver 314 is for selectively discharging the ink from the printing head 12 at a predetermined timing. The driver 314 receives a signal, which is generated in the ASIC 306 on the basis of a drive control procedure outputted from the CPU 300 and is then outputted, and drive-controls the printing head 12.

Next, feeding of sheets by means of the above control means and control of the printing operation are described. The control mean can change a pattern of feeding the sheet P to either the intermittent feeding mode (the first mode) or continuous feeding mode (the second mode). In the first mode, a plurality of sheets are fed intermittently to the printing region 210. The first mode is an accurate mode in which printing precision is prioritized. In the second mode, a plurality of sheets is fed to the printing area continuously and sequentially. The second mode is a speedy mode in which the printing speed is prioritized.

When power is applied to the multifunction device 1, control is started. The user presses a mode setting button (not shown) of the operation panel 30 to select either the first mode or the second mode. When the first mode is selected, the front edge of a sheet P, which is fed by the supply roller 7, is aligned with a contact line between the pair of feed-in rollers 20*a*, 20*b* rotating in the reverse direction, in which state feeding of the sheet P is stopped once. Even if the front edge of the sheet P is fed by the supply roller 7 such that the front edge of the sheet P is inclined with respect to the contact line between the pair of feed-in rollers 20*a*, 20*b*, the front edge of the sheet P is aligned with the contact line. The first mode is suitable for print on a sheet designed for photograph because color heterogeneity or color drift can be prevented by the first mode.

When the first mode (precision priority mode, intermittent feeding mode) is selected, the controller set the power transmission switching means 100 to the first mode. The controller largely moves the carriage 13 positioned at the position 5 (Po5) toward the printing area as shown by arrow C in FIG. 33. Thus, the first block 104 pressed by the biasing spring 106*a* moves in the direction C along with the regulating piece 110 of the circular groove section 109*b*. As a result, the carriage 13 is disengaged from the circular groove section 109*b* and engaged with the first set section 111. The carriage 13 is kept at position 1 (Po1).

In this state, when the LF motor 42 is rotated in the reverse direction, the feed-in drive roller 20*a* is rotated in the reverse direction (counterclockwise direction in FIG. 14). On the other hand, the supply roller 7 is rotated in the forward direction (counterclockwise direction in FIG. 14) by the gear train inside the arm 6*a*. When the supply roller 7 is rotated in the forward direction, the plurality of sheets P, which are stacked in the cassette 5, are caused to abut on a separating member (not shown) of the separating inclined surface 15 provided at the front edge of the cassette 5, the separating member having a high frictional coefficient. Then, only one uppermost sheet P is taken out from the cassette 5 and sent toward the U-shaped sheet guide 9. At this moment, since the feed-in roller 20*a* is rotated in the reverse direction, the sheet P which is fed by the supply roller 7 cannot pass through between the feed-in drive roller 20*a* and the feed-in driven roller 20*b*. The front edge of the sheet P is aligned with the contact line between the pair of feed-in rollers 20*a*, 20*b*. Even if the front edge of the sheet P fed by the supply roller 7 is inclined, the front edge of the sheet P is aligned with the contact line between the pair of feed-in rollers 20*a*, 20*b*.

Next, the LF motor 42 rotates in the forward direction through an appropriate number of steps, the switching gear 102 and the feed-in drive roller 20*a* rotates in the forward direction (clockwise rotation in FIG. 11), and the sheet P between the feed-in drive roller 20*a* and the feed-in driven roller 20*b* is nipped and fed toward the printing area. The sheet P is fed by a predetermined distance after the LF motor 42 started rotation in the forward direction. As a result, the front edge of the sheet P is set at a print starting position inside the printing area. This process is called "heading process".

At this time, the drive shaft 14 in the supply unit 6 rotates in the reverse direction, one of the gear among the gear train in the arm 6*a* are disengaged, and the supply roller 7 become free to rotate around the drive shaft 14. The sheet P is released from between the top of the stacked sheets and supply roller 7 by setting the force of nipping between the pair of feed-in rollers 20*a*, 20*b* greater than keeping force to keep the sheet P between the top of the stacked sheets and supply roller 7. The keeping force is caused by a torsion spring that press the supply roller 7 against the top of the stacked sheets.

Subsequently, when a printing command is inputted from an external computer or the like, which is not shown, the controller starts printing with discharging ink from the nozzles of the printing head 12 onto a surface of the sheet P while the carriage 13 is caused to move in the Y-direction, at the same time advancing the sheet P intermittently. When advancing the sheet P intermittently, the pair of feed-in rollers 20*a*, 20*b* and the pair of feed-out rollers 21*a*, 21*b* rotate in the same direction (forward direction).

When printing one sheet is finished, feeding out of the printed sheet P is started. In doing so, the LF motor 42 rotates in the forward direction through the number of steps in order to make the pair of feed-in rollers 20*a*, 20*b* and the pair of feed-out rollers 21*a*, 21*b* rotate continuously in the forward direction, and then the rotation of the LF motor 42 is stopped.

Next, it is determined whether printing data for a sheet (next page) is present or not. If the print data exists, the above described processes are repeated. In this manner, the sheets P are fed to the printing area (the printing unit 10) one by one. In this mode, a color picture, for example, can be printed accurately.

During above described processes, at the position 1 (Po1), the connecting lever 104*a* pressed toward the direction shown by arrow C by the first biasing spring 106*a* is kept at the position of the first set section 111. In the same way, at the position 2 (Po2), the connecting lever 104*a* is kept at the position of the second set section 112 that is one step lower than the first set section 111. In this manner, once the connecting lever 104*a* is kept at a given position, the carriage 13 is moved only for printing. Therefore, it is no need for the carriage 13 to move to the power transmission switching means 100 for heading process. Speeding up the whole printing process on the high quality (intermittent feeding) mode is achieved.

Next, a case in which the second mode is set is explained. The power transmission switching means 100 is set to the second mode. In the second mode, the quality of a print it not important, but the printing speed is prioritized, thus a plurality of sheets P are continuously and sequentially fed to the printing unit 10. Therefore, the power of the feed-in roller 20*a* and the feed-in roller 20*b* nipping and feeding the sheets is set larger than the power of the supply roll 7 feeding the sheets, and the circumferential speed of the feed-in roller 20*a* is set higher than the circumferential speed of the supply roller 7. The circumferential speed of the feed-in roller 20*a* is set, for example, based on the speed reduction ratio between the continuous feeding gear 114 and the intermediate gear 120.

Then, the carriage 13 positioned at the position 1 (Po1) is moved a predetermined amount in the direction of the arrow E, as shown in FIG. 32. Accordingly, the connecting lever 104*a* is pressed in the E direction at the first engaging step section 13*a* of the carriage 13. During the period in which the connecting lever 104*a* is positioned at the second set section 112, the switching gear 102 and the continuous feeding gear 114 are geared with each other, and the power is transmitted to the drive shaft 14 of the rear end of the arm 6*a* via one intermediate gear (not shown). After that, even if the carriage 13 moves in the direction of the arrow C (moves into the printing area), the connecting lever 104*a* is kept at the second set section 112 that is one step lower than the first set section 111, because the connecting lever 104*a* is pressed by the first biasing spring 106*a*.

When the LF motor 42 rotates in the forward direction in order to start feeding a sheet P, the switching gear 102 and the feed-in drive roller 20*a* rotates in the forward direction, and the supply roller 7 also rotates in the forward direction (counterclockwise direction in FIG. 11). The supply roller 7 separates only one uppermost sheet P and feeds it to the U-shaped sheet guide 9. When the front end section of the sheet P reaches the contact line between the feed-in drive roller 20*a* and the feed-in driven roller 20*b*, the front end of the sheet P is nipped and drawn into between the feed-in drive roller 20*a* and the feed-in drive roller 20*b* since the feed-in roller 20*a* is rotated in the forward direction, and is then fed toward the printing area (printing unit 10). Then, printing starts. During the second mode, it is preferable that the ASIC 306 is set not to accept the output signals (ON or OFF signals) from the sheet sensor 117.

When one piece of sheet P is held between the pair of feed-in rollers 20*a*, 20*b* and is in contact with the supply roller 7, since the power of the pair of feed-in rollers 20*a*, 20*b* nipping and feeding the sheet is set larger than the power of the supply roller 7 pressing the sheet, and the circumferential speed of the feed-in drive roller 20*a* is set higher than the circumferential speed of the supply roller 7, thus the sheet P is fed reliably toward the printing area at the feeding speed of the feed-in roller 20*a*. The sheet P slides with respect to the supply roller 7.

Next, when a command indicating that print data to be printed on the next page (subsequent sheet) exists is received from the external device, it is determined whether the current flag is the first mode or the second mode. When the fag is the second mode, the LF motor 42 continues to rotate in the forward direction and the feed-in drive roller 20*a*, feed-out drive roller 21*a* and supply roller 7 are continued to rotate in the forward direction. Accordingly, the preceding sheet (preceding page) is discharged from the printing unit 10, while the following sheet (subsequent page) is conveyed to the print starting position, and start printing on the following sheet. In this matter, the continuous rotation of the supply roller 7 and the pair of the feed-in roller makes the printing operation for a plurality of sheets faster without temporary stopping at the contact line between the pair of feed-in rollers 20*a*, 20*b*.

Figure 35:
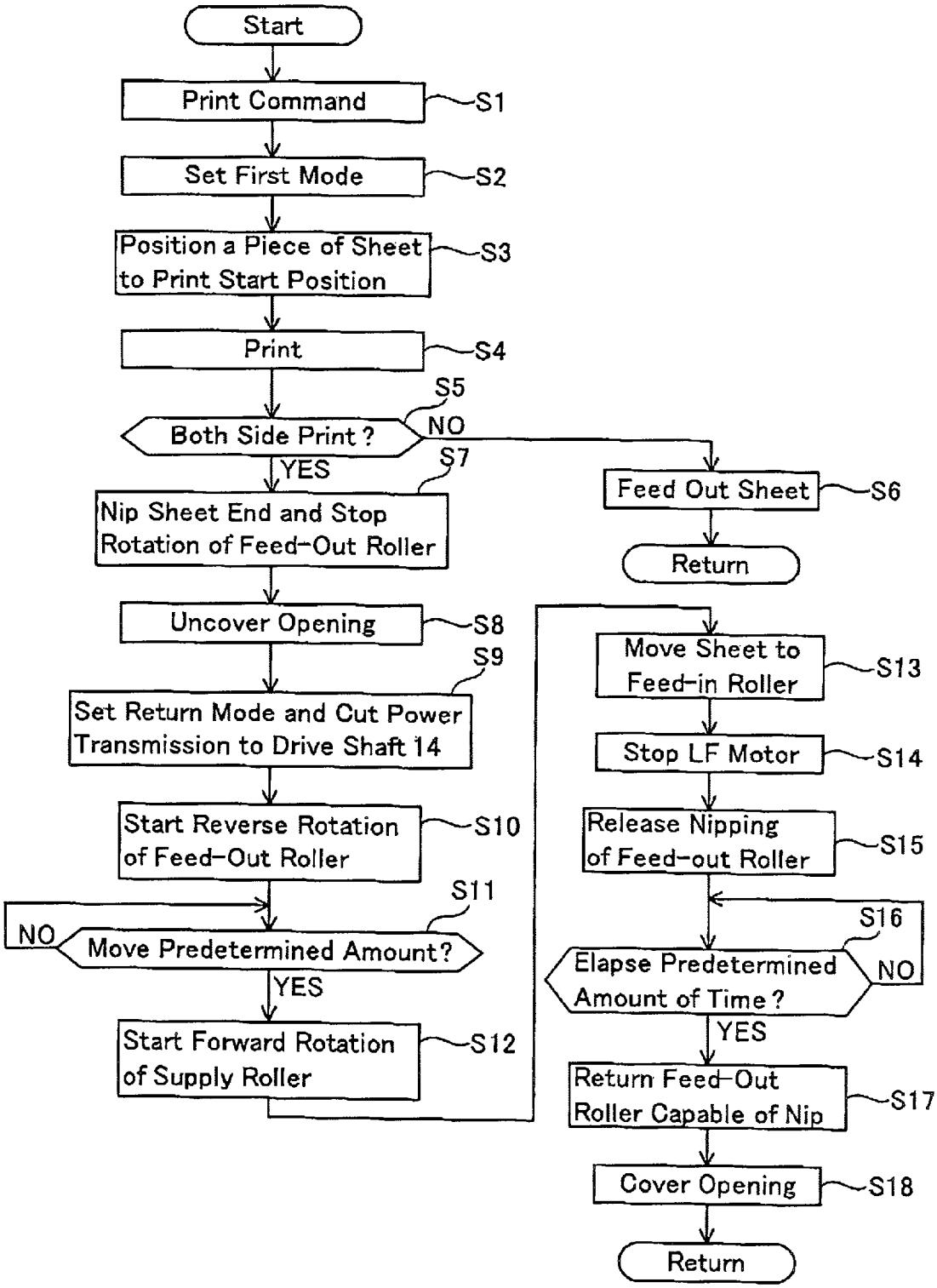
FIG. 35 is a flow chart that controls transportation of a sheet in double-side printing.

Next, referring to a flowchart of FIG. 35, control of double-side printing will be described with the control section described above. In the double-side printing, after printing on one side of the sheet, the printing unit 10 prints on the other side of the sheet again. The printing on one side of the sheet and that on the other side are performed in the first mode, namely, the intermittent feeding mode.

When the multi-function device 1 is powered on and then there is any print command (Step S1: hereinafter referred to as S1. Same in other steps) from an external computer (not shown), the carriage 13 stopping at the above stand-by position (the home position; the position 5 (Po5)) is moved in the arrow C direction, as shown in FIG. 33. Thus, similarly to the above description, the power transmission switching means 100 is set to the first mode (S2).

Figure 15:
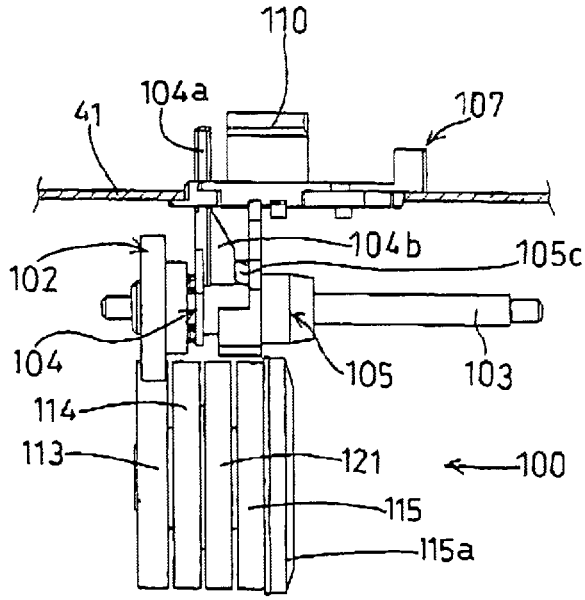
FIG. 15 is a front view illustrating power transmission while a sheet is fed in the intermittent feeding mode (first mode).
Figure 16:
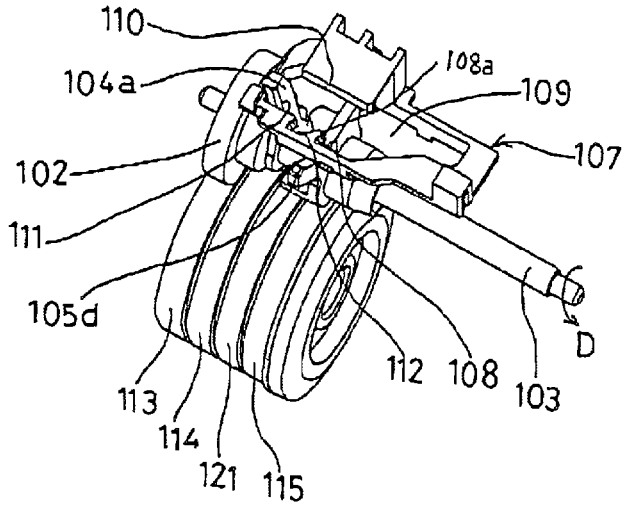
FIG. 16 is a perspective view illustrating power transmission while a sheet is fed in the intermittent feeding mode (first mode).
Figure 17:
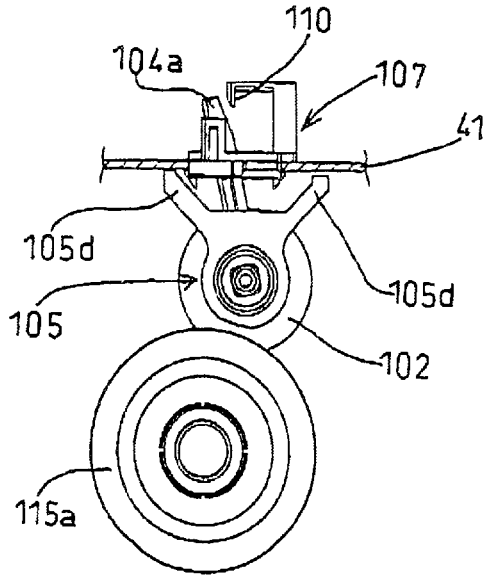
FIG. 17 is a side view illustrating power transmission while a sheet is fed in the intermittent feeding mode (first mode).
Figure 18:
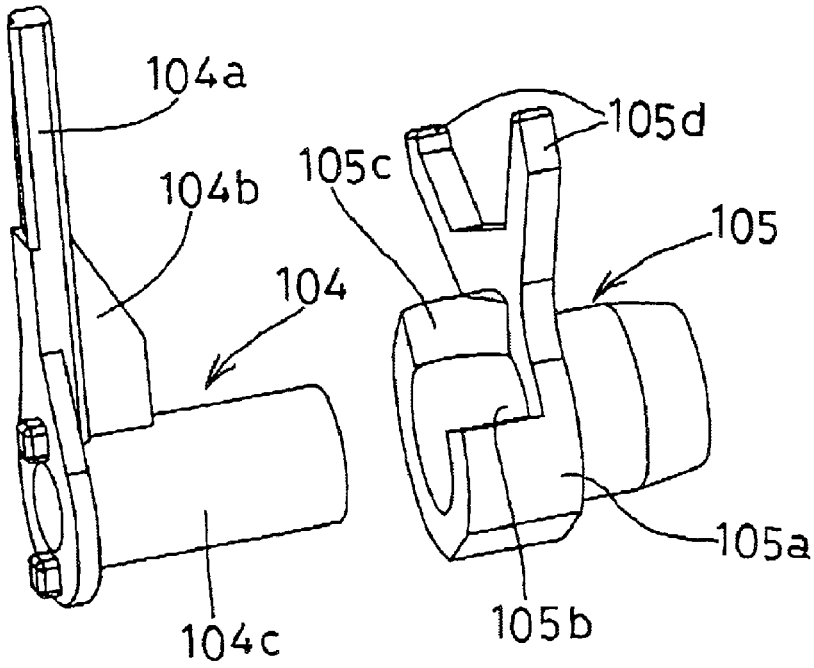
FIG. 18 is a perspective view of a first slider (first block) and a second slider (second block).

As shown in FIG. 15 to FIG. 17, with the switching gear 102 engaged with an intermittent feeding gear 113, sheet feeding from the cassette 5 is enabled. When the LF motor 42 rotates in the reverse direction for the sheet feed operation (S3), the supply roller 7 rotates in the direction that feeds the sheet toward the printing unit 10.

When the LF motor 42 rotates in the reverse direction, the feed-in drive roller 20*a* also rotates in the reverse direction. Thus, the sheet P fed by the supply roller 7 does not enter between the pair of feed-in rollers 20*a*, 20*b*. A top sheet P of the stacked sheets in the cassette 5 is discharged toward the printing unit 10. The discharged sheet is guided by the U-shaped sheet guide 9. After the front end of the sheet P passes through a sheet sensor 117 located in the downstream of the U-shaped sheet guide 9, the LF motor 42 rotates in the reverse direction till a predetermined number of steps is reached. In other words, the LF motor 42 continues to rotate in the reverse direction till the sheet P abuts the contact line between the pair of feed-in roller 20*a*, 20*b*. Then, the LF motor 42 rotates in the forward direction as many steps as appropriate. Thus, the front end of the sheet P is positioned at a print start position (S3).

Then, ink is selectively jetted onto one side of the sheet P from the nozzles of the print head 12, while the sheet P advances intermittently, and the carriage 13 reciprocates along the main scanning direction. In other words, printing takes place (S4). When the sheet P is positioned at the print start position and printed, the drive shaft 14 rotates in the reverse direction. Thus, the supply roller 7 is in a freely rotatable condition. In addition, as the pair of feed-in rollers 20*a*, 20*b* and that of feed-out rollers 21*a*, 21*b* rotate in the forward direction, the sheet P intermittently travels from the inlet to the exit of the printing unit 10.

When printing on one side of the sheet P terminates, the one side printed sheet P is pulled out from the printing unit 10 by the pair of feed-out rollers 21*a*, 21*b*. "The one side printed sheet P" is referred to as just "the sheet P" herein after. Until the rear and on the sheet P reaches at the pair of feed-out rollers 21*a*, 21*b*, it is determined whether or not double-side printing is requested (S5). If the double-side printing is not requested (S5: NO), the LF motor 42 continuously rotates in the forward direction. The sheet P is discharged to the discharge unit (arrow B direction in FIG. 7) (S6). In the case where single-side printing is requested, processes S3 to S6 are repeated.

When the double-side printing is requested (S5: YES), the LF motor 42 continuously rotates in the forward direction until the rear end of the sheet P is reaches the pair of feed-out rollers 21*a*, 21*b*. When the rear end of the sheet P reaches the pair of feed-out rollers 21*a*, 21*b*, the LF motor 42 stops (S7). In fact, it suspends with the rear end of the sheet P nipped by the pair of feed-out rollers 21*a*, 21*b*.

Then, the solenoid 49 is actuated ON, and the sub-plate 46 is moved to the uncovering position. In fact, the opening 50 is uncovered (S8). Next, the carriage 13 travels laterally for a predetermined distance, and the power transmission switching means 100 is maintained in the condition in which the switching gear 102 is engaged with the idle gear 121 (see FIG. 25 to FIG. 27). Power transmission to the drive shaft 14 of the LF motor 42 is cut (S9) in the condition where the switching gear 102 is engaged with the idle gear 121. The supply roller 7 is in the freely rotatable condition. The processes in S8 and S9 may take place substantially at the same time.

Then, with the sub-plate 46 still retained in the uncovering position, the LF motor 42 rotates in the forward direction. The pair of feed-out rollers 21*a*, 21*b* rotates in the reverse direction (S10). With this, the sheet P one side of which is printed travels with the rear end thereof as a head. The rear end of the sheet P is referred to as return side front end hereinafter. The sheet P is transferred through the opening 50 toward the cassette 5 (see FIG. 12).

It is then determined whether or not the sheet P one side of which is printed has traveled a first predetermined amount (S11). The first predetermined amount is a distance traveled by the return side front end of the one side printed sheet P from the position of being nipped between the pair of feed-out rollers 21*a*, 21*b* down to the position where the supply roller 7 is in contact with the top of the stacked sheet (to be more accurate, down to a position beyond the contact position of the supply roller 7 and the top of the stacked sheets. The first predetermined amount can be detected by the rotary encoder 44. Traveling for the predetermined distance, the return side front end of the sheet P that passes below the arm 6*a* slides between the top of the stacked sheets and the supply roller 7 that is in the freely rotatable condition.

After the sheet P travels for a predetermined distance (S11: YES), the carriage 13 moves for a predetermined distance in the arrow C or E direction and the power transmission switching means is set to the first mode. Then, the switching gear 102 is engaged with the intermittent feeding gear 113. In this condition, the LF motor 42 rotates in the forward direction, thereby turning the supply roller 7 in the forward direction (S12). This discharges the one side printed sheet P from the cassette 5 to the printing unit 10. The discharged sheet P is guided by the U-shaped sheet guide 9 and moves to the pair of feed-in rollers 20*a*, 20*b*. In this condition, the pair of feed-in rollers 20*a*, 20*b* rotates in the reverse direction.

Then, the sheet P travels till it abuts the contact line of the pair of feed-in rollers 20*a*, 20*b* (S13). When the front end of the sheet P reaches the contact line of the pair of feed-in rollers 20*a*, 20*b*, the LF motor 42 stops (S14). The supply roller 7, the pair of feed-in rollers 20*a*, 20*b* and the pair of feed-out rollers 21*a*, 21*b* stops.

In this condition, the force of nipping the sheet P by the pair of feed-out rollers 21*a*, 21*b* is released (S115). To be specific, the carriage 13 travels in the arrow C or E direction and the backend surface 13*c* of the carriage 13 presses the contact lever 59. Then, as described earlier, the roller holder 53 raises, and the feed-out driven rollers 21*b* leave the top face of the feed-out drive roller 21*a*.

Then, the carriage 13 moves in the arrow C or E direction in FIG. 32, the power transmission switching means 100 is switched to the first mode (intermittent feeding mode). In fact, the switching gear 102 engages with the intermittent feeding gear 113. Then, the LF motor 42 rotates in the forward direction, thereby turning the pair of the feed-in rollers 20*a*, 20*b* and that of the feed-out rollers 21*a*, 21*b* in the forward direction. By doing so, the front end of the one side printed sheet P is carried between the printing head 12 and the main plate 45 (S16). In this case, as the nipping force of the pair of feed-out rollers 21*a*, 21*b* is released, the one side printed sheet P does not return to the discharge direction (arrow B direction), even if the feed-out roller 21*a* rotates in the forward direction.

Then, after a predetermined time duration corresponding to length of the sheet P has passed (S16: YES), the pair of feed-out rollers 21*a*, 21*b* returns to the condition in which they can nip. In step S16, it may be determined that the sheet P travels for a second predetermined amount, rather than that the predetermined time duration has passed. When the step S16 determines "YES", the one side printed sheet P has already exited from the in-between the pair of feed-out rollers 21*a*, 21*b*. Then, the carriage 13 travels to the arrow C. The backend surface 13*c* (back abutting area) of the carriage 13 leaves the contact lever 59. Then, the roller holder 53 descends, and the feed-out driven rollers 21*b* come into contact with the feed-out drive roller 21*a*. In fact, the pair of feed-out rollers 21*a*, 21*b* returns to the condition that they can nip the sheet (S17).

Then, the solenoid 49 is actuated OFF to cover the opening 50 (S18). In this condition, the rear end of the one side printed sheet P is already located below the sub-plate 46. Even if the opening 50 is closed, the sheet P will not be sandwiched between the opening 50 and the sub-plate 46. Then, same steps as steps S3 and S4 are repeated, and printing on the other side of the sheet P takes place. With the processes described above, the double-side printing takes place.

With the processes described above, the double-side printing takes place. The multi-function device 1 has enabled double-side printing of a sheet P with a fewer number of components.

In the above embodiment, the supply roller 7 is in contact with the top sheet of the stacked sheets in the cassette 5 even in the return mode. Preferably, the following configuration may replace this. In the return mode, the arm 6*a* raises and releases the supply roller 7 from the top of the stacked sheets. In such a condition, one side printed sheet passes through the opening 50, and returns to the top of the stacked sheets. At this time, the supply roller 7 may rotate in the forward direction or in the reverse direction because the supply roller 7 is not in contact with the top of the stacked sheets. An actuator such as a separate electromagnetic solenoid, etc. may be utilized to raise the arm 6*a* in a predetermined timing. In addition, it is also preferable to elevate the arm 6*a* with mechanism similar to that for elevating the roller holder 53 by moving the carriage 13 in the direction approaching to the maintenance unit 36.

As described above, the multi-function device 1 comprises a printing unit 10, a cassette 5, a supply unit 6, a sheet support plate 11, a cover plate 46, and a pair of feed-out rollers 21*a*, 21*b*. The printing unit 10 has a printing head 12 for jetting ink onto a sheet P. The cassette 5 is located below the printing unit 10 and contains stacked sheets. The supply unit 6 discharges a sheet from the cassette 5 to the printing unit 10. The sheet transported into the printing unit 10 is placed on the sheet support plate 11 in the printing unit 10 during printing. An opening 50 is formed on the sheer support plate 11. The cover plate 46 is movable between a position where it covers the opening 50 and a position where it uncovers the opening 50. The pair of feed-out rollers 21*a*, 21*b* nips a sheet at the exit of the printing unit 10, rotates in the forward direction, and pulls the nipped sheet from the printing unit 10. In order to return the nipped and pulled out sheet to the cassette 5 through the opening 50 of the sheet support plate 11, the cover plate 46 is located at the uncovering position when the pair of feed-out rollers 21*a*, 21*b* rotate in the reverse direction.

The multi-function device 1 having the above configuration returns one side printed sheet to the cassette 5 again through the opening 50 formed on the sheet support plate 11 that supports sheets during printing. The one side printed sheet returned to the cassette 5 is transported to the printing unit 10 again by the supply unit 6. The multi-function device 1 can return the one side printed sheet to the cassette 5, simply by conveying it for a short distance. The multi-function device 1 has enabled double-side printing with a fewer components than the conventional mechanism for double-side printing.

In addition, the multi-function device 1 returns the one side printed sheet P to the cassette 5 by reversely rotating the pair of feed-out rollers 21*a*, 21*b* arranged at the exit of the printing unit 10. The return pathway for returning the one side printed sheet to the print area again can be shorter than a conventional printer that bypasses the printing unit. This can accelerate doubleside printing. Then, the pair of feed-in rollers 20*a*, 20*b* and that of feed-out rollers 21*a*, 21*b* are utilized as the rollers, etc. for transporting one side printed sheet to the printing unit 10 once again. This can reduce the number of components for double-side printing.

Until the front end of the one side printed sheet reaches between the supply roller 7 and the top of the stacked sheets, the supply roller 7 may be kept off the top face of stacked sheets in the cassette 5 or the supply roller 7 may be retained in a freely rotatable condition. Such the configuration could make it possible to effectively utilize the supply roller 7 for double-side printing.

The pair of feed-out rollers 21*a*, 21*b* releases the force of nipping a sheet when the supply roller 7 is pressed again against the top of the stacked sheets for double-side printing, or when the supply roller 7 is rotatably driven again for double-side printing. This could prevent the pair of feed-out rollers 21*a*, 21*b* from pulling a sheet when the supply roller 7 discharges one side printed sheet again. This can reliably discharge one side printed sheet to the printing unit 10 once again.

The multi-function device 1 comprises the pair of feed-in rollers 20*a*, 20*b* that nips a sheet in front of the inlet of the printing unit 10, rotates in the forward direction, and thereby transports the nipped sheet into the printing unit 10. The pair of feed-in rollers 20*a*, 20*b* rotates in the same direction as that of the pair of feed-out rollers 21*a*, 21*b*. As there is no need of separately controlling the pair of feed-in rollers 20*a*, 20*b* and that of feed-out rollers 21*a*, 21*b*, the controller can be simplified.

In the multi-function device 1, when the sub-plate (cover plate) 46 covering the opening 50 at the covering position, the top face forms a plane together with the top face of the sheet support plate 11. When the sub-plate 46 is at the uncovering position, the top face of the sub-plare 46 is inclined to the top face of the sheet support plate 11. This could enable opening and closing of the opening 50 even in a smaller range of travel. In addition, a smaller actuator for moving and tilting the sub-plate 46 may be used.

The printing unit 10 of the multi-function device 1 has a printing head 12 of ink jet type that selectively jets ink droplets toward a sheet. The sheet support plate 11 have the capability of defining a gap between a sheet P to be placed thereon and the printing head 12. At the same time, the sheet support plate 11 forms the opening 50 and has the capability of acting as a guide for directing one side printed sheet to the cassette 5. The device can be miniaturized by having the sheet support plate 11 serve 2 functions.

The present invention shall not be limited to the embodiments illustrated in the above description and drawings, but may be carried out by making various changes without departing from the scope of the gist.

For instance, in the above embodiment, after the front end of the sheet P abuts to the contact line of the pair of feed-in rollers 20*a*, 20*b* that rotates in the reverse direction, the LF motor 42 is stopped. That is, the supply roller 7, the pair of feed-in rollers 20*a*, 20*b* and that of the feed-out rollers 21*a*, 21*b* stop. In that condition, the roller holder 53 raises, thereby releasing the feed-out driven rollers 21*b* from the feed-out drive roller 21*a*. It is not limited to the above timing when to release the feed-out driven rollers 21*b* from the feed-out drive roller 21*a*. The feed-out driven rollers 21*b* may leave the feed-out drive roller 21*a* at any time between the following (a) and (b) timing:

(a) When the front end of one side printed sheet P reaches a point between the supply roller 7 and the top of stacked sheets in the cassette 5.

(b) When the pair of feed-in rollers 20*a*, 20*b* starts to rotate in the forward direction to transport the one side printed sheet P into the printing unit 10.

What is claimed is:

1. A printer comprising:

a printing unit for printing onto a piece of sheet;

a cassette located below the printing unit and for containing stacked sheets;

a supply unit for feeding a piece of sheet from the cassette toward the printing unit;

a sheet support plate located in the printing unit, on which the piece of sheet fed from the cassette is placed while being printed, and an opening being formed on the sheet support plate;

a cover plate located in the printing unit, being movable between a covering position that covers the opening and an uncovering position that uncovers the opening; and a pair of feed-out rollers that nips the piece of sheet at the exit of the printing unit and rotates in a forward direction to pull out the nipped piece of sheet from the printing unit;

wherein the cover plate is at the covering position during printing, and the cover plate is at the uncovering position when the pair of feed-out rollers that pulls out the nipped piece of sheet rotates in a reverse direction and guides the piece of sheet through the opening of the sheet support plate to a refeed position between the cassette and the supply unit.

2. The printer as of claim 1, wherein:

the supply unit has a supply roller driven to rotate;

the supply roller is pressed against the top of the stacked sheets for feeding a piece of sheet on the top of the stacked sheets toward the printing unit;

the supply roller is released from the top of the stacked sheets when the piece of sheet returns to the top of the stacked sheets; and the supply roller is pressed again against the top of the stacked sheets after the piece of sheet returns to the top of the stacked sheets.

3. The printer as of claim 2, wherein the pair of feed-out rollers releases the force of nipping when the supply roller is pressed again against the top of the stacked sheets.

4. The printer as of claim 1, wherein:

the supply unit has a supply roller that is pressed against the top of the stacked sheets; the supply roller is driven to rotate for feeding a piece of sheet on the top of the stacked sheets toward the printing unit;

the supply roller becomes freely rotatable when the piece of sheet returns to the top of the stacked sheets; and the supply roller is driven again after the piece of sheet returns to the top of the stacked sheets.

5. The printer as of claim 4, wherein the pair of feed-out rollers releases the force of nipping when the supply roller is driven again.

6. The printer as of claim 1, wherein:

the top face of the cover plate forms a plane together with the top face of the sheet support plate when the cover plate is at the covering position; and the top face of the cover plate is inclined to the top face of the sheet support plate when the cover plate is at the uncovering position.

7. The printer as of claim 1, further comprising a pair of feed-in rollers that nips the piece of sheet in front of the inlet of the printing unit and rotates in the forward direction to feed the nipped piece of sheet into the printing unit, wherein the pair of feed-in rollers and the pair of feed-out rollers rotate simultaneously in the same direction.

8. The printer as of claim 1, wherein the printing unit has a printing head of ink jet type that selectively discharges ink droplets toward a piece of sheet.

9. The printer as of claim 1, wherein the supply unit includes a supply roller for feeding the piece of sheet from the cassette toward the printing unit, and the refeed position is a position between the cassette and the supply roller.

* * * * *